US007088291B2

(12) United States Patent
Yamaguchi et al.

(10) Patent No.: US 7,088,291 B2
(45) Date of Patent: Aug. 8, 2006

(54) ANTENNA MODULE

(75) Inventors: Shuichiro Yamaguchi, Miyazaki-gun (JP); Keisuke Maruyama, Koyu-gun (JP); Hiromi Tokunaga, Miyazaki-gun (JP); Kazuhiro Eguchi, Miyazaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/061,728

(22) Filed: Feb. 22, 2005

(65) Prior Publication Data

US 2005/0184910 A1 Aug. 25, 2005

(30) Foreign Application Priority Data

Feb. 20, 2004 (JP) ..... 2004-044274

(51) Int. Cl.
*H01Q 1/38* (2006.01)

(52) U.S. Cl. ..... 343/700 MS; 343/895; 343/702

(58) Field of Classification Search ..... 343/700 MS, 343/895, 702, 873, 772
See application file for complete search history.

(56) References Cited

U.S. PATENT DOCUMENTS 5,973,651 A * 10/1999 Suesada et al. ..... 343/752
5,977,927 A * 11/1999 Mandai et al. ..... 343/788
6,137,998 A * 10/2000 Holshouser et al. ..... 455/129
6,288,680 B1 * 9/2001 Tsuru et al. ..... 343/702
6,486,853 B1 11/2002 Yoshinomoto et al.
6,567,049 B1 * 5/2003 Huang et al. ..... 343/700 MS
6,822,620 B1 * 11/2004 Watada et al. ..... 343/895
6,836,074 B1 * 12/2004 Nakamura ..... 315/169.3
2004/0108967 A1 6/2004 Fujimura et al.
2004/0201531 A1 10/2004 Fujimura e tal.
2005/0057430 A1 3/2005 Noguchi et al.
2005/0231429 A1 10/2005 Noguchi et al.

FOREIGN PATENT DOCUMENTS

EP 1 037302 9/2000
EP 1 460715 9/2004
JP 1 0178312 6/1998
JP 1 0290707 11/1998
JP 2002207535 7/2002

* cited by examiner

*Primary Examiner*—Hoang V. Nguyen
*Assistant Examiner*—Huedung X. Cao
(74) *Attorney, Agent, or Firm*—Stevens, Davis, Miller & Mosher, LLP

(57) ABSTRACT

This invention provides an antenna module comprising: a helical antenna 1 including a base 2 and a pair of terminals 4, 5 and a helical area formed on the base 2; a power supply 7 for supplying power to one of the pair of terminals 4, 5 of the helical antenna 1; an opening connected to the other of the pair of terminals; an antenna substrate 9 on which the antenna 7 is mounted; a grounding area 10 formed in the vicinity of the power supply 7; and a peripheral conductor 16 formed at least a portion on the periphery of the antenna substrate 9, wherein the peripheral length of the peripheral conductor 16 formed on the periphery of the antenna substrate 9 is nearly integer times as long as ¼ wavelength of a resonance frequency.

33 Claims, 21 Drawing Sheets

| | EXAMPLE A | EXAMPLE B | EXAMPLE C |
|---|---|---|---|
| AVERAGE GAIN (dBi) | -3.2 | -3.7 | -7.4 |

ANTENNA MODULE

BACKGROUND OF THE INVENTION

1. Field of the Invention

This invention relates to an antenna module which is suited to mobile communications and an electronic device such as a personal computer for executing radio communication.

2. Description of the Related Art

In recent years, portable terminals have been-widely used which are provided with a whip antenna and an internal antenna for communication and also another antenna for radio communication of data between themselves and other electronic devices.

Further, portable mobile electronic devices such as a notebook personal computer which execute radio data communication through wireless LAN have been also widely used. These mobile electronic devices incorporate antennas.

Further, the electronic device such as a portable terminal and a notebook personal computer in recent years are requested to incorporate an antenna for radio communication. However, since the antenna itself is incorporated, it is demanded that the gain and directivity of transmission/reception is assured or improved without influencing the structure/package or appearance of the electronic device.

Further, as regards these electronic devices, their slimming, downsizing and high-density packaging have advanced year after year. Correspondingly, downsizing of an incorporated antenna and in packaging for assuring the gain of the antenna have been also demanded.

In order to fulfill the above demand, a pattern antenna was formed on the rear surface of a box, otherwise the external shape of the box was partially deformed to form the antenna (e.g. JP-A-2002-207535 and JP-A-10-290707).

However, in the case where the pattern antenna is formed on the rear surface of the box, the antenna is greatly upsized so that the space therefor must be ensured. This is a serious problem for the electronic device whose sliming and downsizing is indispensable.

Further, where the pattern antenna or the antenna constructed by a laminated electronic component is placed on a mounting substrate existing on the rear surface of the box or inside thereof, such a problem occurs that a sufficient transmission/reception gain cannot be obtained because of an external box. Particularly, in order to assure both the light weight and strength of the box, as the case may be, the outer wall of the box is made of an Mg alloy. If the outer wall is made of such a metal, it constitutes a shield. Thus, it is difficult to execute the transmission/reception between the internal antenna and the outside.

In the case of the antenna with a projection formed on the outer wall of the box, the appearance is not elegant. Such a antenna is inferior in design, and above all is not comfortable for a user. In addition, such an antenna brings about malfunction or damage.

Further, in such a case, because of the structure of the box or antenna, the gain and directivity of transmission/reception cannot be assured sufficiently.

SUMMARY OF THE INVENTION

In view of these problems, an object of this invention is to provide an antenna module which can improve the gain and directivity transmission/reception while realizing downsizing and slimming without damaging the appearance and usability of an electronic device.

This invention provides an antenna module comprising: a helical antenna including a base and a pair of terminals and a helical area formed on the base; a power supply for supplying power to one of the pair of terminals of the helical antenna; an opening connected to the other of the pair of terminals; an antenna substrate on which the antenna is mounted; a grounding area formed in the vicinity of the power supply; and a peripheral conductor formed at least a portion on the periphery of the antenna substrate, wherein the peripheral length of the peripheral conductor formed on the periphery of the antenna substrate is nearly integer times as long as 02~0.3 wavelength of a resonance frequency.

In accordance with the configuration of this invention, by using a helical antenna as an antenna, a small-sized antenna module which is optimally incorporated in an electronic device can be realized. In addition, without externally protruding a redundant projection from a box, the antenna module can be incorporated in the electronic device.

Thus, the outer appearance of the electronic device is not impaired, and inconvenience in use or the cause for failure can be excluded.

Further, since the grounding area is provided on the side of the power supply of the helical antenna, even where the helical antenna is a ¼λ type antenna, the image current generated in a grounded plane can be effectively used. The antenna module which facilitates further downsizing of the helical antenna and realizes the higher gain thereof can be realized.

Further, since with the power supply being provided at the one end of the antenna substrate and the opening being provided at the other end thereof, the peripheral length of the peripheral conductor from the power supply is integer times as long as 0.2~0.3λ of the resonance frequency, the peripheral conductor serves as a radiating substrate, thereby giving further merits of further improving the gain and assuring high directivity.

Further, the antenna module provided with such an antenna substrate can be easily built in a part of a box of the electronic device. Thus, the downsizing and sliming of the electronic device can be realized and the manufacturing process thereof can be simplified.

Further, by designing the conductive portion of the box to serve as the peripheral conductor of the antenna substrate, some redundant designing step or member can be made unnecessary, thereby further facilitating downsizing of the antenna module and reducing the production cost. Thus, without hindering the slimming and downsizing of the electronic device, the gain of transmission/reception of the antenna module can be improved.

Further, the antenna module can be manufactured in such a manner that the antenna substrate and helical antenna are mounted in the mounting dent of the recess formed in the box And such an antenna module can be incorporated in the electronic device without protruding a redundant projection therefrom. Further, the periphery of the helical antenna can be formed of the conductive portion of the box or formed on the antenna substrate so that the antenna module can be mounted in the electronic device without impairing the downsizing thereof. Further, by setting the peripheral length of the peripheral conductor at integer times as long as 0.2~0.4 λ, the peripheral conductor serves as a radiating substrate so that the gain can be further improved and the high directivity can assured. Particularly, even if the box is coated with e.g. an Mg alloy, since the mounting dent is exposed, the radiation of transmission/reception by the helical antenna is not influenced.

Particularly, by providing the mounting dent at any position of the end surfaces of the box, the outer appearance of the electronic device is made elegant and the manufacturing process thereof is also simplified. Further, external radiation of radio waves is done with a high gain. Further, by coating the outer surface of the mounting dent with the protective member, the endurance of the antenna module can be increased.

As the case may be, the peripheral length of the mounting dent formed by the recess is not necessarily integer times as long as ¼λ according to the conditions of the electronic device. In such a case, by providing the additive conductor whose area or length can be adjusted by trimming at the one of the antenna substrate, the peripheral length of the conductive portion on the periphery of the helical antenna can be varied. In this way, the peripheral length can be adjusted to integer times as long as ¼λ which gives the highest gain of radiation. Accordingly, without disturbing downsizing of the electronic device and its outer appearance, the antenna module capable of assuring a high gain of transmission/reception can be realized.

DESCRIPTION OF THE PREFERRED EMBODIMENTS

Figure 1:
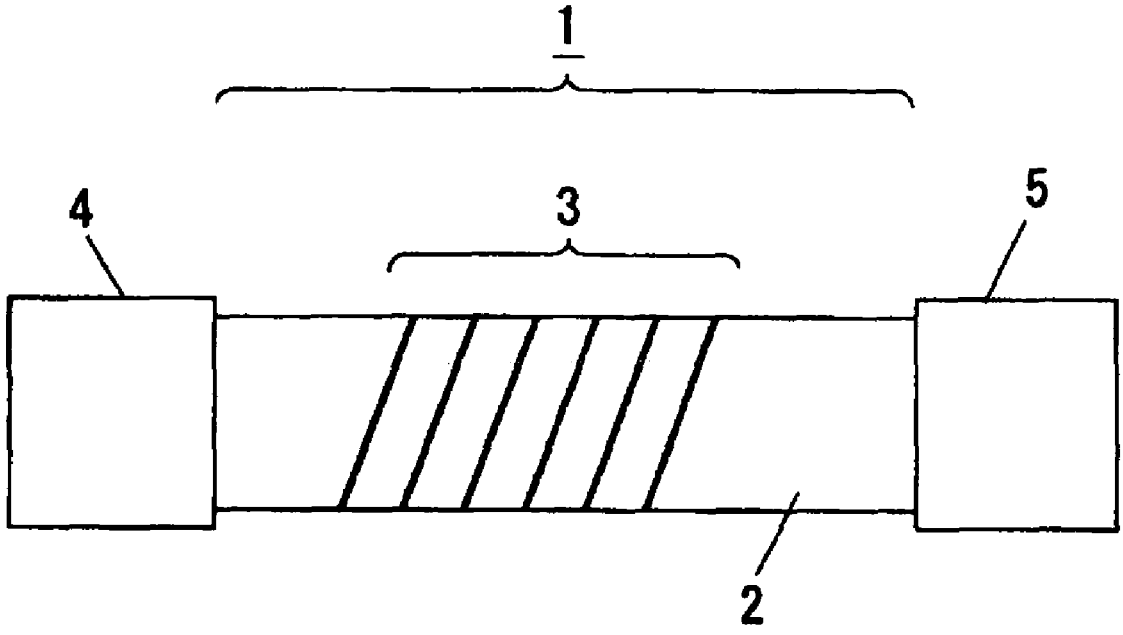
FIG. 1 is an arrangement view of a helical antenna according to a first embodiment of this invention.

The invention described in claim 1 of this invention is an antenna module comprising: a helical antenna having a base, and a pair of terminals and a helical segment formed on the base; a power supply for supplying power to one of the pair of terminals; an opening connected to the other of the pair of terminals; an antenna substrate on which the antenna is mounted; a grounding area formed in the vicinity of the power supply; and a peripheral conductor formed at least a portion of the periphery of the antenna substrate, wherein the peripheral length of the peripheral conductor formed on the periphery of the antenna substrate is nearly integer times as long as 0.2~0.3 wavelength of a resonance frequency. In accordance with this configuration, the antenna module can be realized which incorporates the antenna without impairing the outer appearance of an electronic device and external protruding a redundant projection and keeping the downsizing of the device, and also can improve the gain and directivity of transmission/reception of the incorporated antenna.

The invention described in claim 2 of this invention is an antenna module according to claim 1, wherein the peripheral length of the peripheral conductor formed on the periphery of the antenna is nearly integer times as long as 0.2~0.3 wavelength of the resonance frequency from an origin of the power supply. In accordance with this configuration, the antenna module can be realized which incorporates the antenna without impairing the outer appearance of an electronic device and external protruding a redundant projection and keeping the downsizing of the device, and also can improve the gain of transmission/reception and directivity of the incorporated antenna.

The invention described in claim 3 is an antenna module according to claim 1 or 2, wherein an additive conductor is provided at a partial area on the antenna substrate other than the periphery thereof. In accordance with this configuration, the antenna module can be realized which incorporates the antenna without impairing the outer appearance of an electronic device and external protruding a redundant projection and keeping the downsizing of the device, and also can improve the gain and directivity of transmission/reception of the incorporated antenna. In this case, the peripheral length of a conductive portion for improving the gain of transmission/reception can be adjusted according to the size of the antenna substrate and changes in a transmission/reception frequency.

The invention described in claim 4 of this invention is an antenna module according to any one of claims 1 to 3, wherein the additive conductor is electrically connected to the peripheral conductor. In accordance with this configuration, the downsizing of the electronic device is further promoted.

The invention described in claim 5 of this invention is an antenna module according to any one of claims 1 to 4, wherein the peripheral length of a conductive portion composed of the additive conductor and the peripheral conductor and formed on the periphery of the helical antenna is nearly integer times as long as 0.2~0.3 wavelength of the resonance frequency. In accordance with this configuration, the conductive portion is employed as if it is an antenna, thereby increasing radiation of radio waves to improve the gain of transmission/reception.

The invention described in claim 6 of this invention is an antenna module according to any one of claims 1 to 5, wherein the length or area of at least one of the additive conductor and the peripheral conductor is changeable. In accordance with this configuration, even if the transmission/reception frequency is not suited to the length of the antenna substrate or the periphery conductor, the peripheral length of the conductive portion can be adjusted to nearly integer times, thereby improving the gain of transmission/reception.

The invention described in claim 7 of this invention is an antenna module according to claim 6, wherein the area is changed by trimming. In accordance with this configuration, the adjustment can made easily and afterwards.

The invention described in claim 8 of this invention is an antenna module according to any one of claims 1 to 7, wherein the additive conductor is formed on the side opposite to the grounding area. In accordance with this configuration, the peripheral length of the conductive portion can be assured by a minimum area.

The invention described in claim 9 of this invention is an antenna module according to any one of claims 1 to 8, wherein a pattern antenna is connected to the power supply, commonly to the helical antenna. This configuration can easily deal with multi-resonance.

The invention described in claim 10 of this invention is an antenna module according to any one of claims 1 to 9, wherein a top loading conductor is formed at the opening of the antenna.

In accordance with this configuration, a wide bandwidth of the helical antenna can be easily realized.

The invention described in claim 11 of this invention is an antenna module according to any one of claims 1 to 11, wherein a bottom conductor connected to the opening is formed at an area opposite to the helical segment of the helical antenna on the antenna substrate. In accordance with this configuration, the mounting area can be effectively employed to further promote realization of the wide bandwidth.

The invention described in claim 12 of this invention is an antenna module comprising: a mounting dent formed at any portion of a box and having a periphery covered with a conductor; an antenna substrate fit in the mounting dent; an antenna having a base and a pair of terminals and a helical segment formed on the base, the antenna being mounted on the antenna substrate; a power supply for supplying power to one of the pair of terminals, the power supply being provided on the antenna substrate; an opening formed on the antenna substrate and connected to the other of the pair of terminals, wherein the peripheral length of the conductor surrounding the mounting dent is nearly integer times as long as 0.2~0.3 wavelength of a resonance frequency, and the power supply is formed at the one end of the mounting dent. In accordance with this configuration, the antenna module can be realized which incorporates the antenna without impairing the outer appearance of an electronic device and external protruding a redundant projection and keeping the downsizing of the device, and also can improve the gain of transmission/reception and directivity of the incorporated antenna.

The invention described in claim 13 of this invention is an antenna module according to claim 12, wherein the peripheral length of the conductor surrounding the mounting dent is integer times as long as 0.2~0.3 wavelength of the resonance frequency from an origin of the power supply. In accordance with this configuration, the antenna module can be realized which incorporates the antenna without impairing the outer appearance of an electronic device and external protruding a redundant projection and keeping the downsizing of the device, and also can improve the gain of transmission/reception and directivity of the incorporated antenna.

The invention described in claim 14 of this invention is an antenna module according to claim 12 or 13, wherein on the antenna substrate, the conductor is formed at at least a portion of the side which is not opposite to a grounding area and in nearly parallel to the longitudinal direction of the helical antenna. In accordance with this configuration, the peripheral length of the conductor can be easily assured.

The invention described in claim 15 of this invention is an antenna module according to any one of claims 12 to 14, wherein a grounding area is formed in the vicinity of the power supply and at a position opposite to the opening. In accordance with this configuration, the image current of the helical antenna can be used to increase the gain, and the impedance matching at the power supply is facilitated, thereby improving the performance of the helical antenna.

The invention described in claim 16 of this invention is an antenna module according to any one of claims 12 to 15, wherein an additive conductor is formed at an end of the mounting dent opposite to the power supply. In accordance with this configuration, the wide bandwidth of the helical antenna can be realized.

The invention described in claim 17 of this invention is an antenna module according to any one of claims 12 to 16, wherein the length or area of the additive conductor is changeable. In accordance with this configuration, in order to improve the gain of transmission/reception, the peripheral length of the conductor from the power supply can be adjusted to nearly integer times as long as 0.2~0.3 $\lambda$ of the transmission/reception frequency which is an optimum length.

The invention described in claim 18 of this invention is an antenna module according to claim 17, wherein the length or area of the additive conductor is changeable so that the peripheral length of the conductor from an origin of the power supply on the antenna substrate can be adjusted. In accordance with this configuration, in order to improve the gain of transmission/reception, the peripheral length of the conductor from the power supply can be adjusted to nearly integer times as long as $\frac{1}{4}\lambda$ of the transmission/reception frequency which is an optimum length.

The invention described in claim 19 of this invention is an antenna module according to any one of claims 12 to 18, wherein a pattern antenna is connected to the power supply, commonly to the antenna. This configuration can easily deal with multi-resonance.

The invention described in claim 20 is an antenna module according to one of claims 12 to 19, wherein on the antenna substrate, a top-up conductor is formed at the opening of the antenna, and/or a bottom conductor is formed on the surface opposite to the conductor connected to the opening. In accordance with this configuration, the wide bandwidth can be realized with a simple configuration and without requiring a redundant mounting area.

The invention described in claim 21 of this invention is an antenna module according to any one of claims 12 to 20, wherein the mounting dent is a recess formed in any position of the end surface of the box. In accordance with this configuration, the mounting dent can be easily formed.

The invention described in claim 22 of this invention is an antenna module according to any one of claims 12 to 21, wherein the periphery of the mounting dent is covered with a protective member In accordance with this configuration, the endurance or feeling of use can be improved, and the design can be also improved.

The invention described in claim 23 of this invention is n antenna module according to claim 22, wherein the protective member has transparency. In accordance with this configuration, easiness of confirming failure and design improvement can be realized.

The invention described in claim 24 is an antenna module according to any one of claims 12 to 23, wherein the mounting dent is ⊃-shaped. In accordance with this configuration, radiation of radio waves by the conductor on the periphery of the helical antenna can be effectively generated, and the mounting dent can be easily made in the box of the electronic device. This can be realized with good balance.

The invention described in claim 25 is an antenna module according to claim 12, wherein the longitudinal direction of the antenna is in nearly parallel to that of the mounting dent. In accordance with this configuration, the mounting area can be reduced to optimize the electric field distribution in the conductor on the periphery of the helical antenna, thereby improving the gain of transmission/reception.

The invention described in claim 26 of this invention is an antenna module according to claim 12, wherein at least one of the grounding area and the additive conductor is formed on the antenna substrate, at least one of the grounding area and the additive conductor has a connecting segment to the box, and the antenna substrate is connected to the box at the connecting segment through a dielectric member. In accordance with this configuration, the impedance matching can be easily implemented.

Now referring to the drawings, a explanation will be given of various embodiments of this invention.

Incidentally, in this specification, symbol λ denotes a wavelength.

(Embodiment 1)

Referring to FIGS. 1 to 10, first, the shape and structure of an antenna module will be explained and thereafter, its operation and advantage will be explained.

FIG. 1 is a view showing the structure of a helical antenna according to the first embodiment of this invention. FIGS. 2 to 10 are views showing the arrangement of the antenna module according to the first embodiment of this invention.

In these figures, reference numeral 1 denotes a helical antenna; 2 a base; 3 a helical segment; 4, 5 a terminal; 6 antenna module; 7 a power supply; 8 an opening; 9 an antenna substrate; 10 a grounding area; 11 a bonding slot; 12 a pattern antenna; 13 a top-up conductor; 14 an additive conductor, 15 a bottom conductor; 16 a peripheral conductor; 17 a peripheral length; and 18, 19 an additive conductor for adjustment.

First, the details of each component will be explained and its modification or advantage will be explained.

Referring to FIG. 1, the helical antenna 1 will be explained.

The helical antenna 1 includes the base 2, a pair of terminals formed on the base 1 and the helical segment 3 having a spiral partially formed on the base 2.

The base 2 has a shape constituting a helical antenna element. The base 2 is formed by press working or extrusion of an insulating or dielectric material such as alumina and ceramic material having the alumina as a main component. Incidentally, the base 2 may be made of a ceramic material such as forsterite, magnesium titanate series, calcium titanate series, zirconia/tin/titanium series, barium titanate, lead/calcium/titanium series or resin material such as an epoxy resin. In the first embodiment, alumina or ceramic having alumina as a main component. The base is wholly coated with a single or multiple stacked layers of a conductive film of conductive material of Cu, Ag, Au or Ni, thereby forming a conductive surface thereof. The conductive film can be made by plating, deposition, sputtering or pasting.

The base 2 may be structured in any form of a square pillar, a circular pillar, a triangular pillar, a polygonal pillar. If the comer thereof is chamfered, it is possible to prevent the element from cracking or being damaged when the spiral is formed. Now, if the base 2 is made in a form of the circular pillar, because of the absence of the comer, shock-resistance can be increased, thereby giving a merit of facilitating the formation of the spiral.

The surface of the base 2 preferably has pores of 1 to 30% (more preferably 8 to 23%). The pores of such a degree prevent surface corrosion after plating.

As regards the size of the helical antenna, assuming that the length is L, height is H and width is W, it is preferred that $$4.0 \leqq L \leqq 50.0 \text{ mm}$$

$$0.5 \leqq H \leqq 10.0 \text{ mm}$$

$$0.5 \leqq W \leqq 10.0 \text{ mm}$$

However, the size other than such dimensions is not particularly problematic.

Next, the terminals 4 and 5 will be explained.

The terminals 4 and 5 are formed as a pair on the base 2.

In FIG. 1 and others, although these terminals are formed at the ends of the base 2, they may be formed on the way of the base 2. The terminals 4 and 5 may be formed of the same material and in the same manufacturing process as the base 2, but they may be formed of a different material. Further, the terminals 4 and 5 are covered with an conductive film (which may be a thin film such as a conductive plated film, deposited film, and sputtered film or baked applied silver paste) and connected to mounting lands constituting the power supply 7 and opening 8.

Incidentally, the terminals 4 and 5 may be formed integrally to the base 1 or as separately therefrom.

Further, as shown in FIG. 1, the outer periphery of the base 2 may be caused to step down from the terminals 4 and 5, but may have a straight structure with no step-down.

The terminal 4, 5 may be shaped in not a square pillar, but the circular pillar.

Now, since the outer periphery of the base 2 is caused to step down, in mounting, the base 2 can assure a sufficient distance from an antenna mounting substrate, thereby preventing the characteristic deterioration. In this case, the outer periphery of the base 1 may be caused to step down partially or entirely. If the entire outer periphery of the base 1 is caused to step down, in mounting, it is not necessary to select the plane in contact with an electronic substrate, thereby reducing the cost in the mounting.

The helical antenna 1 may be a λ/4 type antenna, or a λ/2. However, in order to promote downsizing, the λ/4 type antenna is mostly used. In this case, the gain of transmission/reception can be assured by using an image current generated in a grounding plane existing in the vicinity of the helical antenna 1. In order to urge the use of the image current, there is preferably the grounding plane having an end face perpendicular to the longitudinal direction of the helical antenna 1. Although described later, in order to generate the image current, the grounding area 10 is provided on the side of the power supply 7.

Next, the helical segment 3 will be explained.

The helical segment 3 is formed of the spiral formed on the base. The spiral serves as a conductive portion of helical windings to generate an inductor component. As seen from FIG. 1, the helical segment 3 is electrically connected to the terminals 4 and 5. Thus, the transmission/reception operation of the antenna can be realized at a resonance frequency which is determined by the capacitive component generated at the terminal 4, 5 or area with no helical segment 3 on the base 2 and the inductor component generated at the helical segment 3.

Incidentally, in the helical segment 3 also, in which any conductive area remains, the resistor component and capacitor component as well as the inductor component may be generated.

The helical segment 3 may be realized by forming the spiral through laser trimming of a conductive film formed on the surface of the base 2, or by winding a conductive wire such as a copper wire or aluminum wire on the base 2.

Additonally, since the helical segment 3 generates the inductor component using the spiral, the magnitude of the inductor component is determined by the number of windings of the spiral. An increased number of windings increases the inductor component whereas a decreased number of windings decreases the inductor component. The magnitude of resonance condition described later is determined in inverse proportion to the square rood of the inductor component. For this reason, in order to realize a high frequency, the number of windings may be decreased, whereas in order to realize a low frequency, the number of windings may be increased. This is apparent also considering that the electrical length of the spiral depends on the shape of the windings.

Further, a plurality of helical segments 3 may be located on the base 3. In this case, since the inductor components are generated at two or more portions, a multi-resonance helical antenna 1 having a plurality of resonance frequencies can be realized together with the other capacitive component.

Now referring to FIGS. 2 to 10, an explanation will be given of the antenna module 6.

Figure 2:
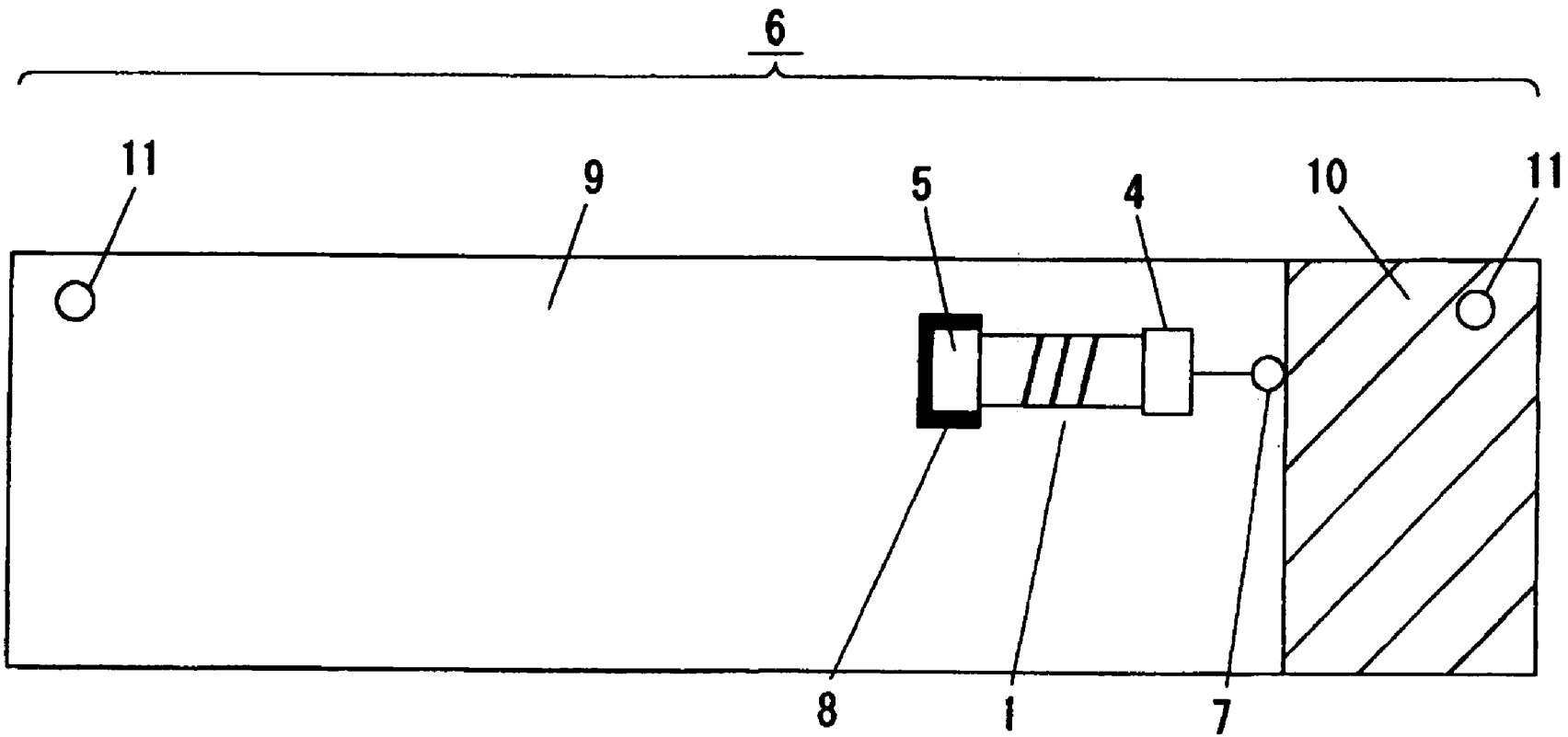
FIG. 2 is an arrangement view of an antenna module according to the first embodiment of this invention.

In FIG. 2 and others, the helical antenna 1 is mounted on the antenna substrate 9 to constitute the antenna module 6. This antenna module 6 is optimally built in a notebook personal computer, portable terminal, other in-home network devices necessitating radio communications, telephone.

An explanation will be given of the details of each of the components of the antenna module 6.

First, the power supply 7 will be explained.

The power supply 7 serves to supply a signal current to the helical antenna 1 or send the signal current received by the helical antenna 1 to a demodulating unit (not shown). The power supply 7 may be formed as a substrate pattern, or using a lead wire, copper wire or coaxial cable.

The power supply 7 is connected to the terminal 4 of the helical antenna 1 so that the signal current can be supplied to the helical antenna 1 through the power supply 7. The connection may be realized by solder bonding using mounting lands or other connecting manners.

The power supply 7 is preferably provided at the end of the antenna substrate 9 and preferably made nearer to the grounding area 10 described later Where the antenna module 6 is housed in a box, the power supply 7 is preferably located in a recess on the side of the one end as a housing space described later.

Next, the opening 8 will be explained.

The opening 8 is hollow so that it does not lead to a power source, signal source and grounding, and is formed as in independent mounting land on the antenna substrate 9. Since the opening 8 is connected to the terminal 5 of the helical antenna 1, emission or reception of radio waves is realized at the resonance frequency depending on the resonance condition.

The antenna substrate 9 is employed to mount the helical antenna 1 and other components. The antenna substrate 9 may be formed by only a substrate as shown in FIG. 2, or may be formed by the substrate and a peripheral conductor 16 on the periphery thereof. The peripheral conductor 16 may be formed previously or afterwards. The peripheral conductor 16 may be formed integrally to the antenna substrate 9 or may be formed as a separate body. The peripheral conductor 16 may be also formed by the conductive area inherently existing in the box.

The helical antenna 1 is mounted on the antenna substrate 9 in its contact with the opening 8 and power supply 7. The grounding area 10 described below is also formed on the antenna substrate 9. Incidentally, the grounding area 10 may be formed on the antenna substrate 9 or may be formed as a separate body.

In order to house the antenna module 7 in the box, a connecting segment (bonding slot) 11 for fitting by bolting, screwing or mortising may be provided.

The grounding area 10 will be explained.

The grounding area 10 is formed in the vicinity of the side of the power supply 7 of the helical antenna 1. For example, the grounding area 10 may be made of a metallic film formed on the antenna substrate 9, may be a composite conductor of e.g. bonded metals, or may be a composite conductor of separate conductors which are bonded or arranged in vicinity of each other.

Further, the grounding area 10 may be electrically connected to the peripheral conductor 17 described below. However, since this grounding area 10 must be kept at a grounding potential by all means, it cannot be connected to the other conductor, particularly the conductive portion having the potential other than ground.

The end surface of the grounding area 10 is preferably nearly perpendicular to the longitudinal direction of the helical antenna 1. The reason therefor is as follows. Since the grounding area 10 is formed nearly perpendicular thereto, the image current generated in the grounding area 10 in the same direction as the longitudinal direction so that helical antenna 1 serves as a ¼λ , thereby assuring sufficient gain.

Figure 3:
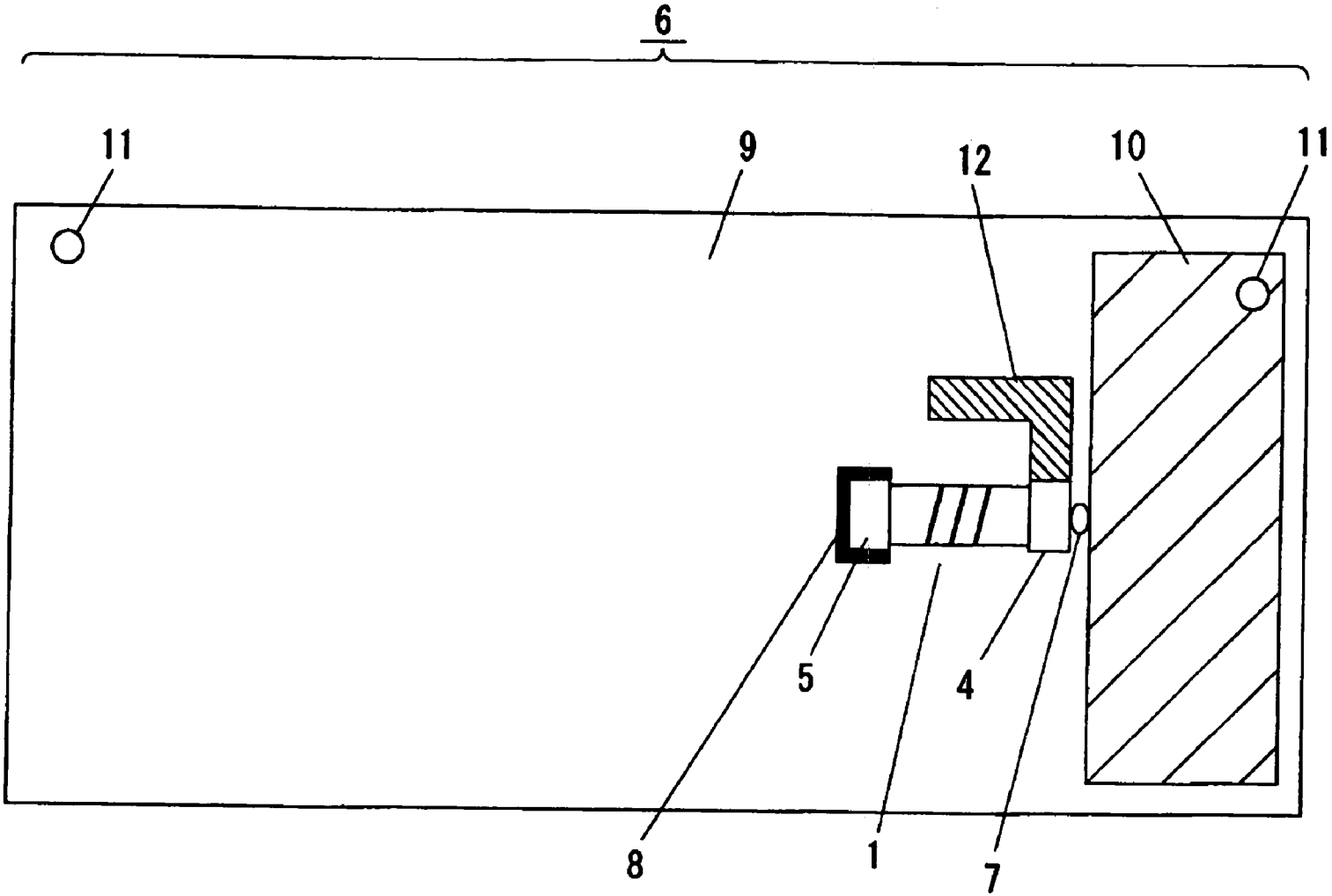
FIG. 3 is an arrangement view of an antenna module according to the first embodiment of this invention.

Now, referring to FIG. 3 and others, an explanation will be given of various modifications.

The pattern antenna 12 is an antenna formed of e.g. a substrate pattern and separately connected to the same power supply 7 as the helical antenna 1 is. If the wavelength of transmission/reception is at a very high frequency and hence very short, the pattern antenna can be appropriately formed to deal with multi-resonance easily For example, where the antenna module 6 is directed to a wireless LAN, its dual mode can be realized in such a manner that the helical antenna 1 corresponds to the transmission/reception frequency of 2.4 GHz and the pattern antenna 12 corresponds to 5 GHz.

Of course, the antennas may correspond to the other frequencies than the above frequencies. Further, in order to deal with not only the dual mode of resonance but also triple or more mode of resonance, preferably, the pattern antenna 12 may be formed in its plurality or its shape may modified.

Further, likewise, with the helical antenna 1 being previously provided with the helical segment 1 in its plurality so as to deal with a multi-mode resonance, if the pattern antenna 12 is further added, the antenna module 6 capable of wide application can be realized to deal with a larger number of frequencies.

Figure 4:
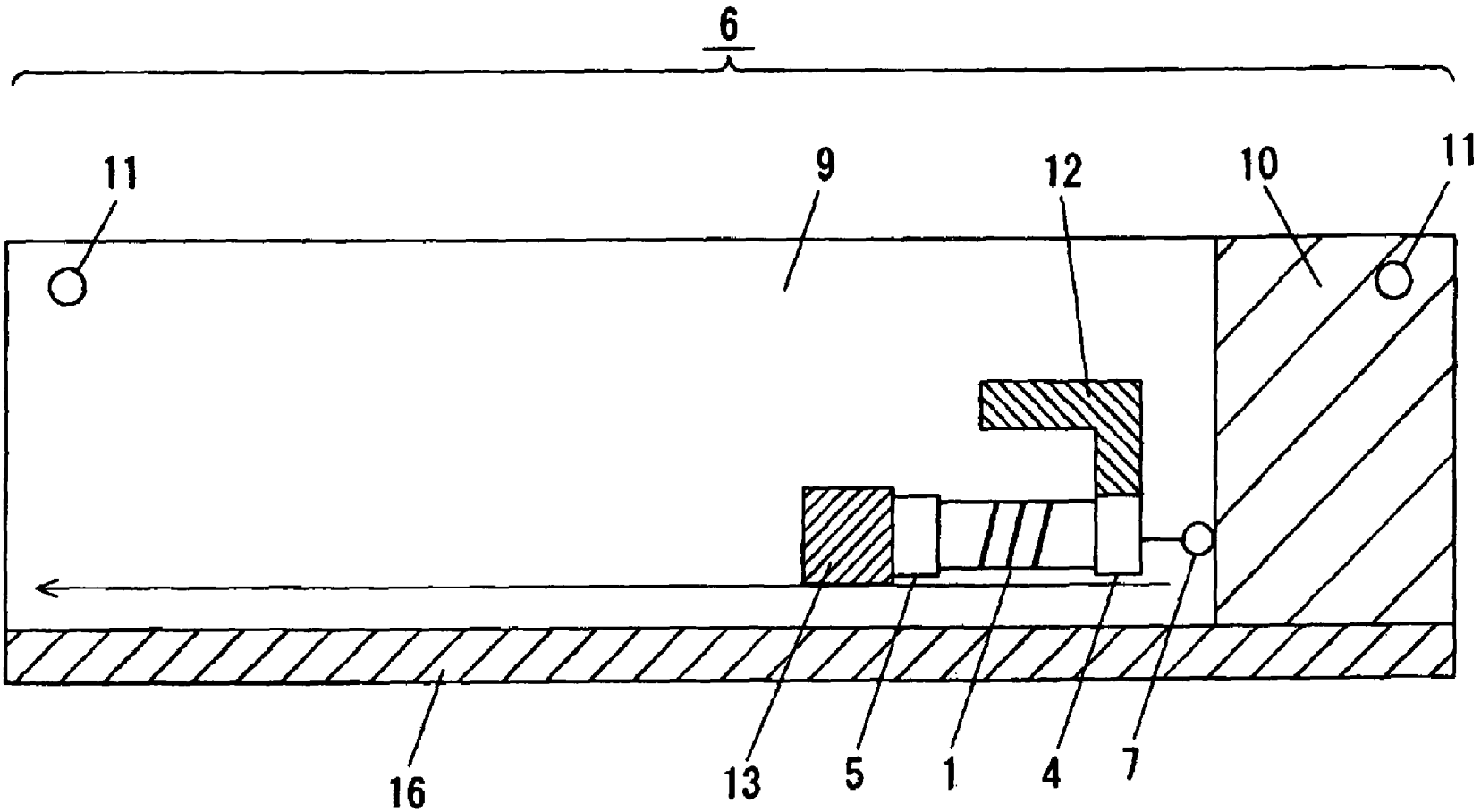
FIG. 4 is an arrangement view of an antenna module according to the first embodiment of this invention.

Referring to FIG. 4, an explanation will be given of the top-cup conductor 13.

The top-cup conductor 13 is a conductor formed at the opening 8. The mounting land where the opening 8 is made may be previously formed in large size. Otherwise, a metallic film, plated layer, pattern layer may be additively connected to the opening 8 to realize the top-cup conductor 13.

Meanwhile, the antenna performance of the helical antenna 1 is determined by the resonance frequency depending on the inductor component generated by the helical segment 3 and the capacitor component generated by the other areas and a Q-value. The top-cup conductor 13 serves to increase the entire capacitance, thereby reducing the Q-value. Particularly, since a load capacitor component is generated with respect to the power supply 7, the rising delay or trailing delay in the frequency characteristic is made gentle using the capacitor load, thereby providing the effect of enlarging the bandwidth. Thus, the provision of the top-up conductor 13 permits the wide bandwidth necessary for communication of a huge quantity of data to be realized.

Figure 7:
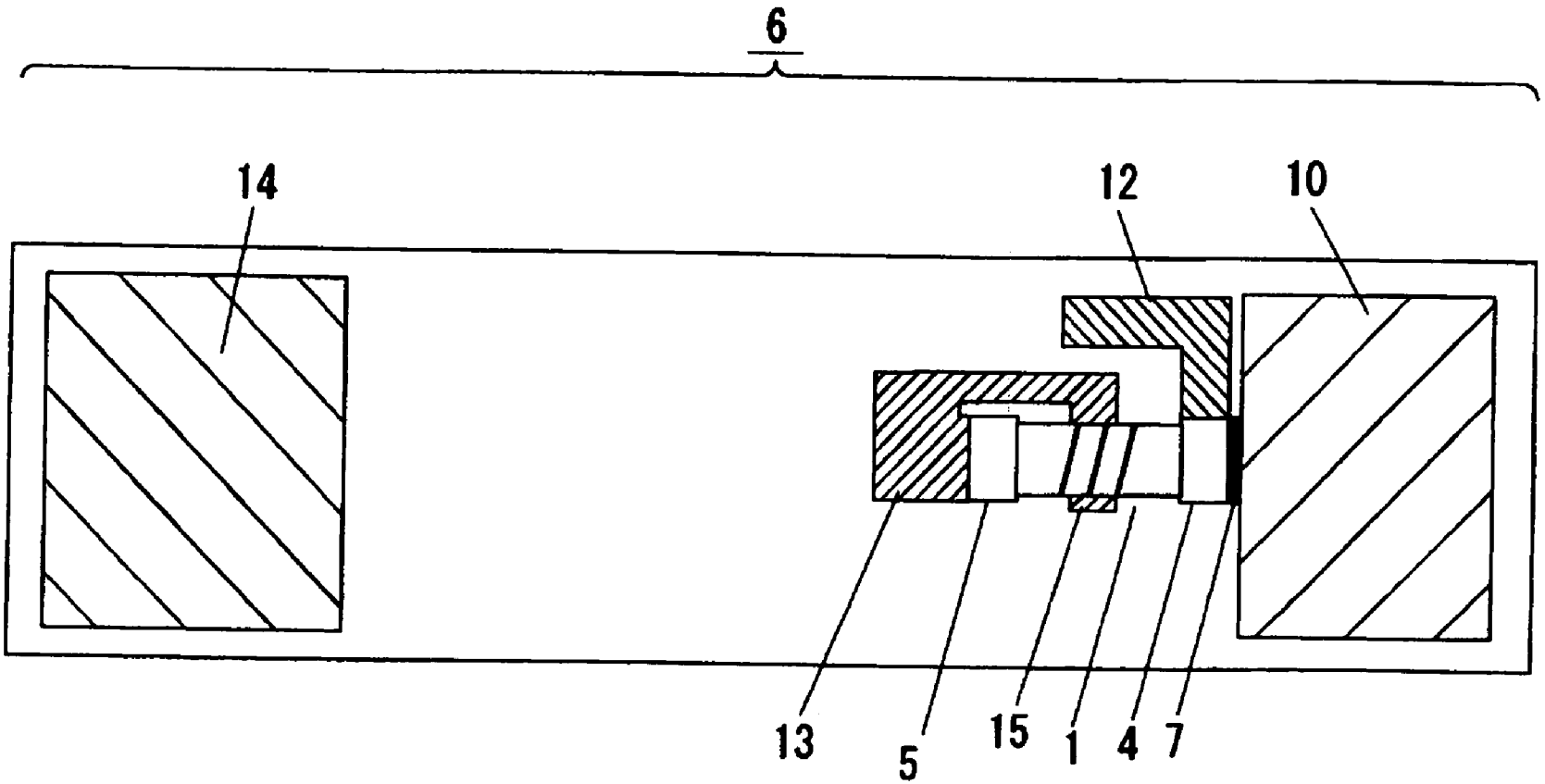
FIG. 7 is an arrangement view of an antenna module according to the first embodiment of this invention.

Likewise, as seen from FIG. 7, the provision of the bottom 15 contributes to realize a wider bandwidth. The bottom conductor 15 is formed on the plane opposite to the helical segment 3 of the helical antenna (e.g. on the antenna substrate 9) by bending the opening 8 (or top-cup conductor 13 connected to the opening 8) and extending it. Thus, the bottom conductor 15 is capacitively coupled with the helical segment 3, thereby generating a capacitor component connected in parallel to the other capacitor component in the helical antenna 1. In the bottom conductor 15, the bottom area of the helical antenna 1 where the other component cannot be mounted inherently is effectively used.

The generation of the capacitor component connected in parallel also increases the entire capacitive component to reduce the Q value, thus further realizing the wide bandwidth.

Figure 5:
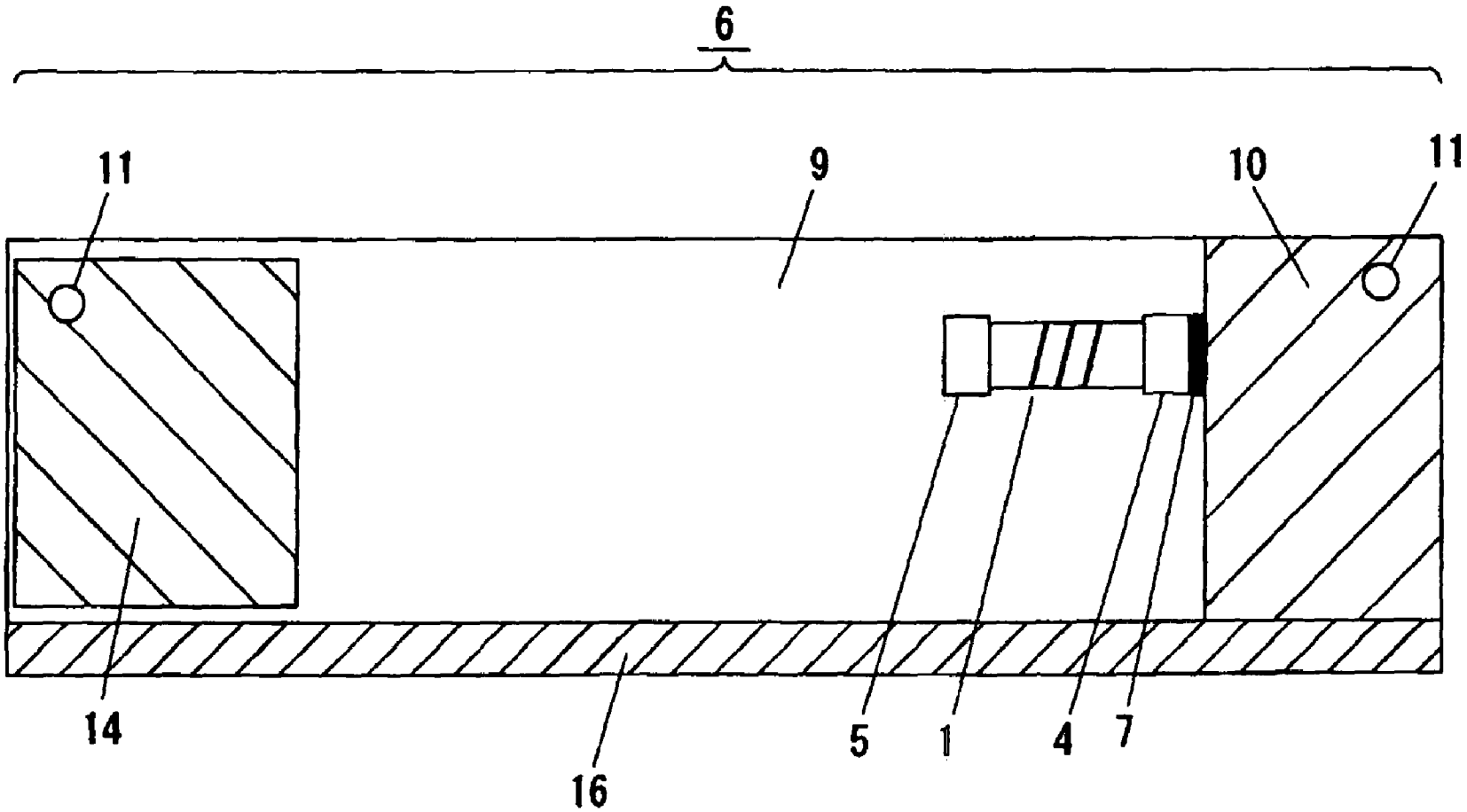
FIG. 5 is an arrangement view of an antenna module according to the first embodiment of this invention.
Figure 6:
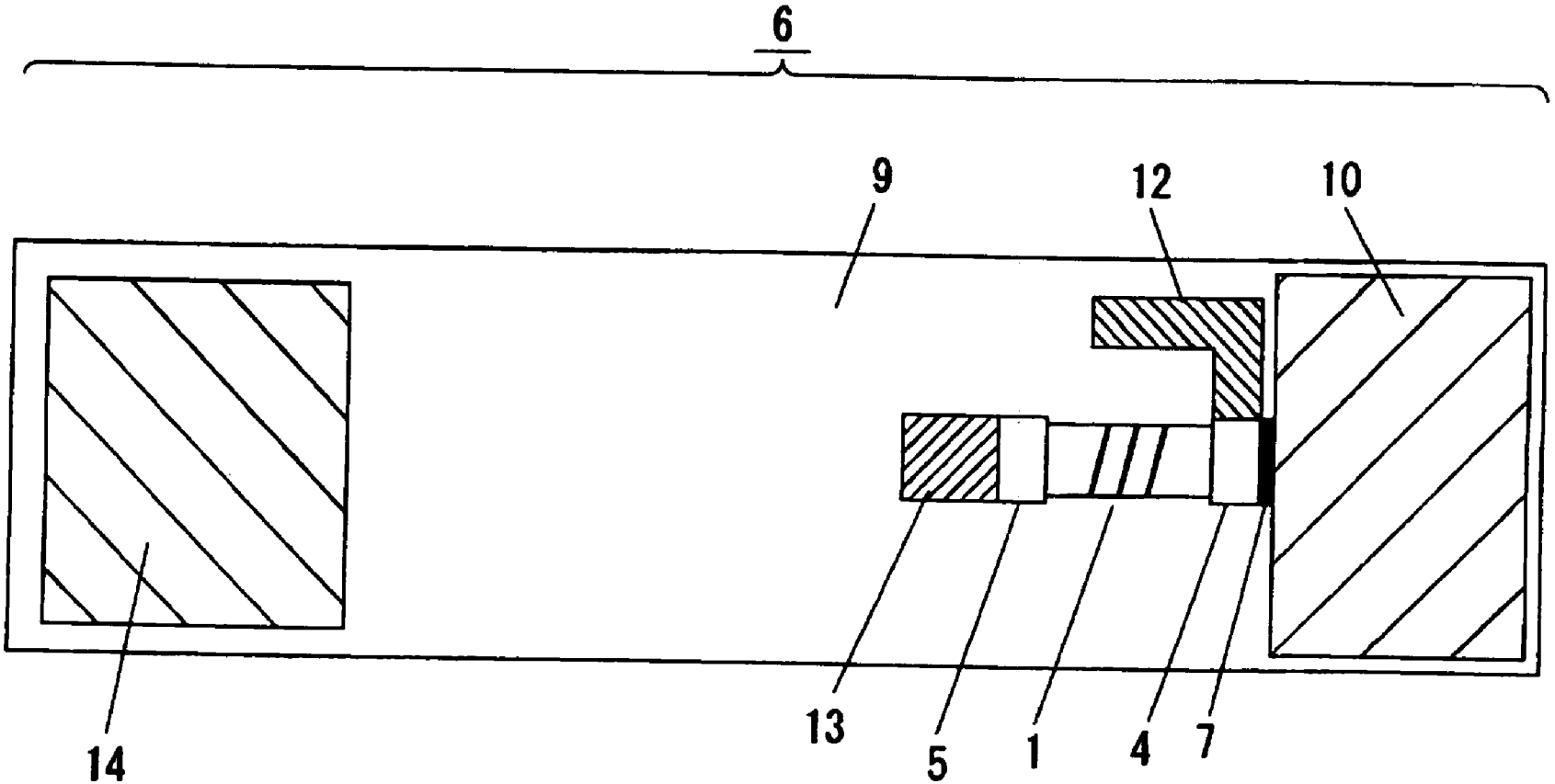
FIG. 6 is an arrangement view of an antenna module according to the first embodiment of this invention.

Although the order of symbol is reversed, the peripheral conductor 16 will be explained. The peripheral conductor 16 is realized as illustrated in FIG. 5 and others.

The peripheral conductor 16 is a conductor formed on the end surface of the antenna substrate 9 in its longitudinal direction. The peripheral conductor 16 is wholly or partially formed in the longitudinal direction. The peripheral conductor 16 may be a metallic film or metallic foil or a substrate pattern on the antenna substrate 9. The peripheral conductor 16 may be formed on the antenna substrate 9, or may be formed by bonding, connecting or arranging conductors formed separately. Further, the peripheral conductor 16 may be also realized by a part of the conductive portion of the box in which the antenna module 6 is fit.

Further, the peripheral conductor 16 may be formed in a short length direction as well as the longitudinal direction of the antenna substrate 9.

Figure 8:
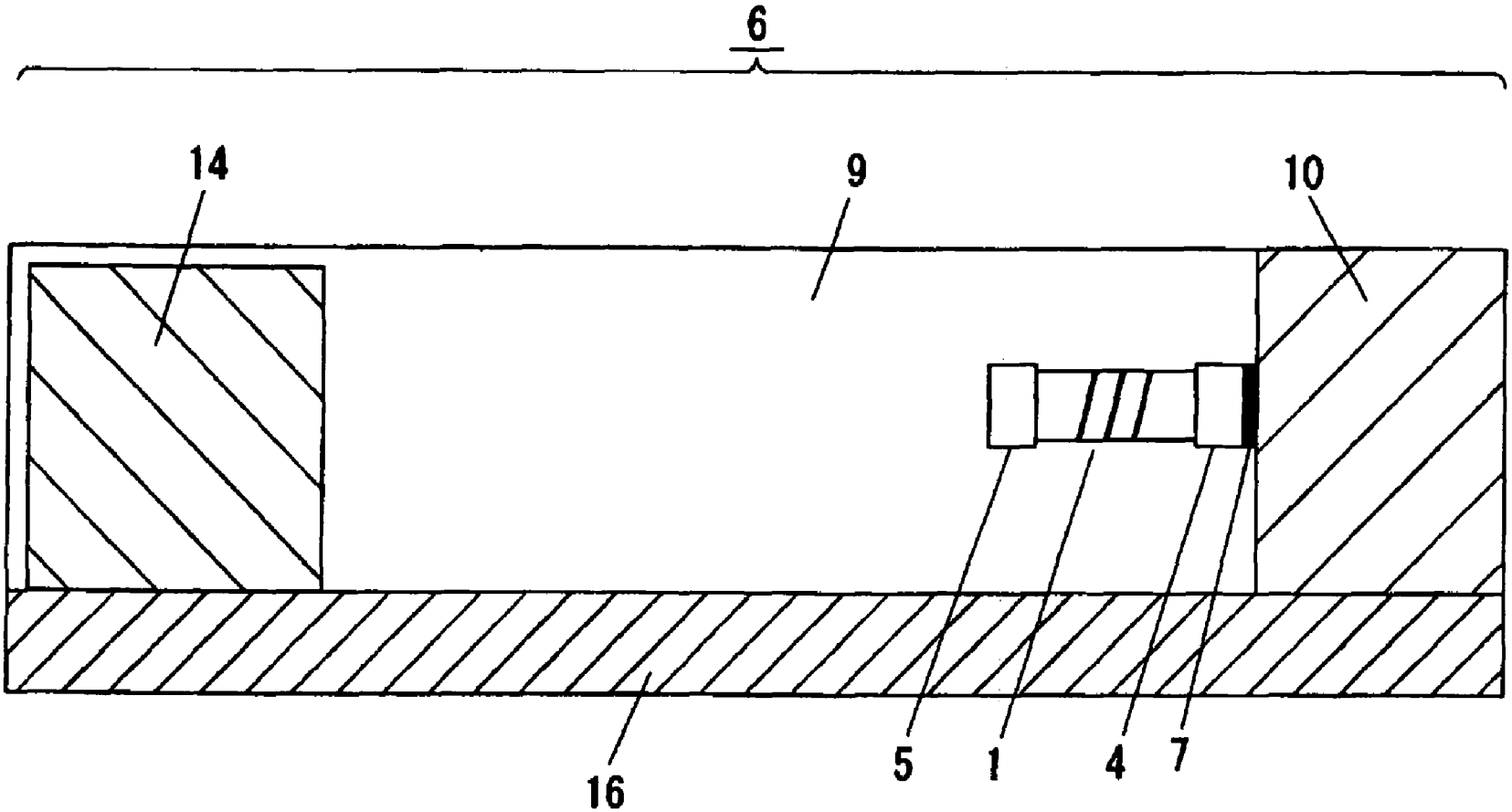
FIG. 8 is an arrangement view of an antenna module according to the first embodiment of this invention.

Further, as seen from FIG. 8, the peripheral conductor 16 may be connected to the grounding area 10, additive conductor 11 or one or all of them, or may be a conductor formed wholly integrally.

Next, the additive conductor 14 will be explained. In FIG. 5 and others, the additive conductor 14 is illustrated. The additive conductor 14 may be any one of the metallic film, metallic foil and conductor pattern formed on the antenna substrate 9. Otherwise, the additive conductor 14 which has been formed as a separate body may be bonded to, connected to and arranged in the vicinity of the antenna substrate 9.

The additive conductor 14, as described later, can be appropriately changed in area and length by laser trimming, stripping executed afterwards.

FIG. 5 and others illustrate the helical antenna 1 mounted in nearly parallel to the longitudinal direction of the antenna substrate 9, and the peripheral conductor 16 formed in the longitudinal direction of the antenna substrate 9. However, according to the shape of the antenna substrate 9 when it is built into the box, the peripheral conductor 16 may be located on the short length side of the antenna substrate 9.

Further, the additive conductor 14 is formed on the side opposite to the power supply 7, i.e. opposite to grounding area 10. Thus, as described later, the peripheral length of the conductive portion surrounding a part of the periphery of the helical antenna 1 can be changed and adjusted to approximately integer times as long as 0.2λ to 0.3λ (preferably ¼λ) of the transmission/reception frequency giving an optimum transmission/reception gain.

Figure 10:
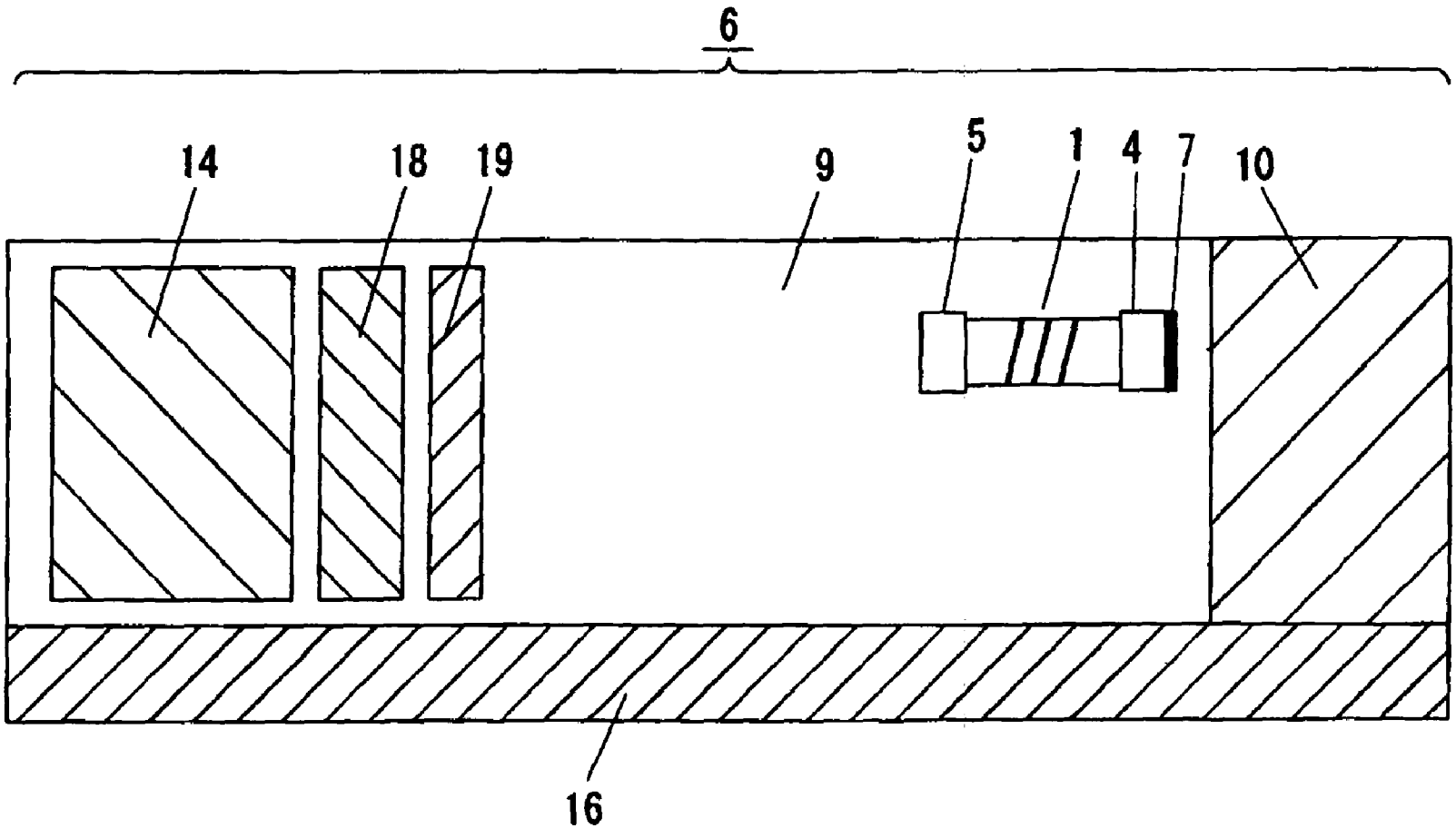
FIG. 10 is an arrangement view of an antenna module according to the first embodiment of this invention.

For example, as seen from FIG. 10, preferably, by forming the additive conductors 18 and 19 as well as the additive conductor 14 and stripping them afterwards, the area of the additive conductor 14 may be easily changed so that the peripheral length of the conductive portion surrounding the helical antenna 1 can be changed.

Next, an explanation will be given of the operation of the antenna module as described above.

Figure 11:
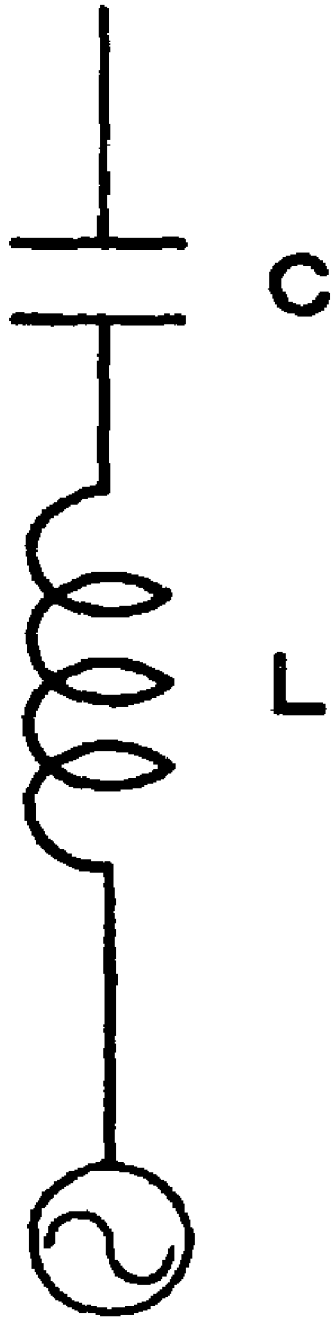
FIG. 11 is an equivalent circuit diagram of the helical antenna according to the first embodiment of this invention.

FIG. 11 is an equivalent circuit diagram of the helical antenna 1 according to the first embodiment of this invention. This equivalent circuit diagram relates to the case where the helical segment 3 is provided in singularity. Where the helical segment is provided in plurality, the number of the inductor components and capacitor components increase in the equivalent circuit diagram.

Assuming that L represents the inductor component and C represents the capacitor component, the resonance frequency is determined by Equation 1

$$f_0 = \frac{1}{\sqrt{LC}} \quad \text{[Equation 1]}$$

The helical antenna 1 performs an operation of transmission/reception at the resonance frequency as determined above.

Figure 9:
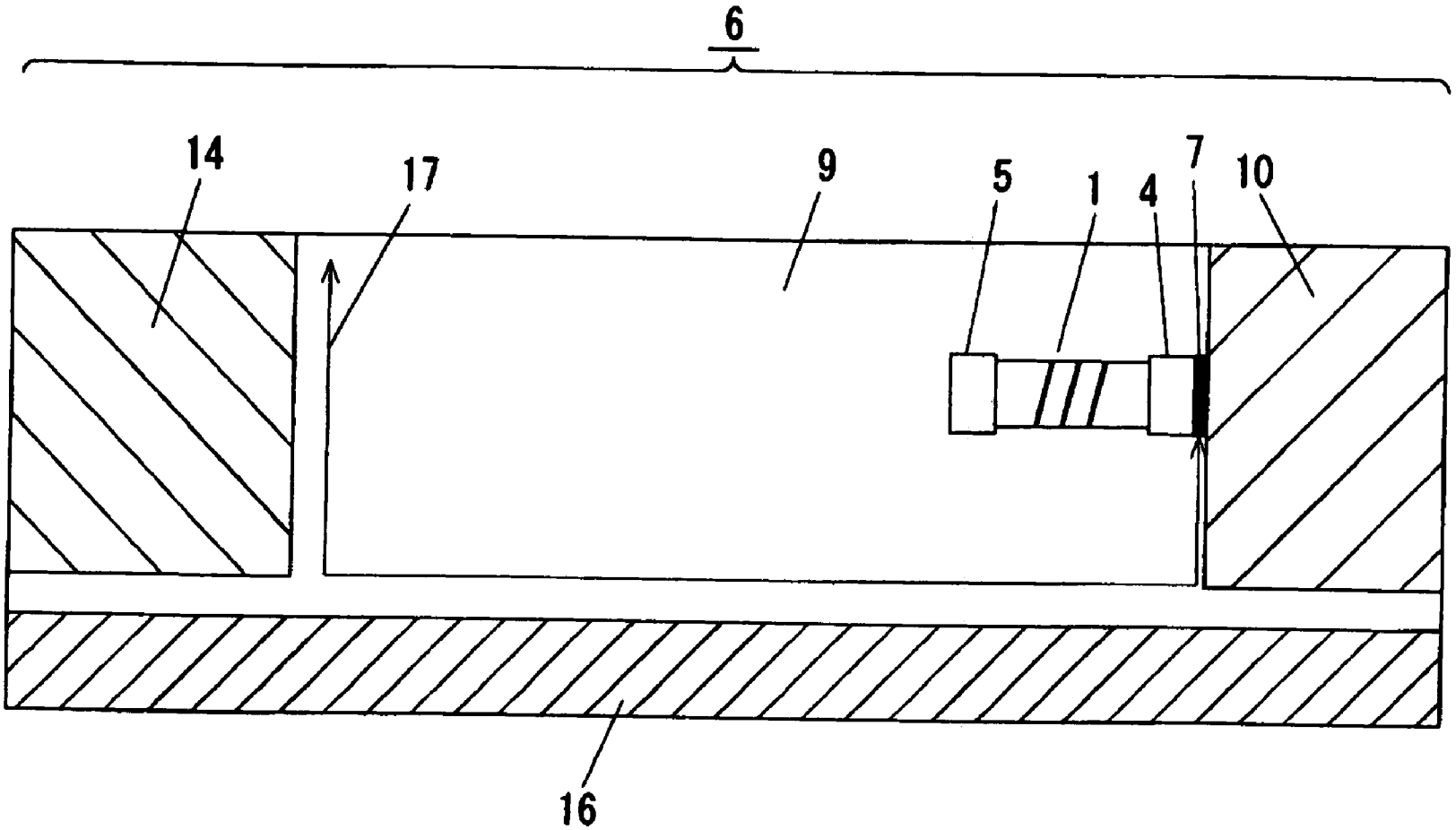
FIG. 9 is an arrangement view of an antenna module according to the first embodiment of this invention.

Next, referring to FIGS. 4 and 9, an explanation will be given of the causes of the improvement of the transmission/reception gain.

The first cause is that since there is the grounding area 10 whose end face is nearly perpendicular to the longitudinal direction of the helical antenna 1, the image current is generated in the same vector direction as the current flowing through the helical antenna 1, thereby improving the gain.

The second cause is that since the power supply 7 is located at the one end of the antenna module 6, the power supply 7 is near the grounding area 10, thereby enhancing the effect of the grounding face of the grounding area 10.

The third cause is that since the peripheral length of the conductive portion of the periphery of the helical antenna 1 (its length if only the peripheral conductor 16 exists, the total length of peripheral conductor 16 and additive conductor 14 if the additive conductor 14 also exists, or the resultant total length of the peripheral conductor 16 and grounding area 10 if the peripheral conductor 16 is connected to the grounding area 10) is set at integer times as long as the ¼ wavelength of the transmission/reception frequency, these conductors serve as a kind of secondary radiation member, thereby increasing the transmission/reception gain.

Specifically, not only the helical antenna 1 but also the conductive portion such as the peripheral conductor 16 formed on the periphery thereof serves as an antenna. And if its peripheral length is nearly integer times as long as 0.2λ to 0.3λ (preferably, ¼λ) of the transmission/reception frequency, the distribution of the electric field is optimum, thereby increasing the gain of transmission (or reception) at this frequency.

Sine these causes are combined with one another, the antenna module 6, even if it is built into the box of an electronic device, can provide a greatly increased gain of transmission/reception.

Additionally, since the length of the peripheral conductor 16 depends on the size of the antenna substrate 9 (where the peripheral conductor 16 is not formed on the antenna substrate 9, but is formed by the conductive portion existing in the box, it depends on the length of the storing area of the antenna module 6 arranged in the box), in many cases, the peripheral length of the conductive portion on the periphery of the helical antenna 1 cannot be made approximately integer times as long as ¼λ according to the condition of the box or electronic device or changes in the transmission/reception frequency.

In this case, by trimming of stripping the additive conductor 14 previously prepared, or adjusting the length of the additive conductor 18, 19 for adjustment, the peripheral length of the peripheral conductor 16 can be adjusted to 0.2λ to 0.3λ (preferably ¼λ, thereby increasing the gain of transmission/reception.

In the configuration hitherto described, the antenna module 6, even if it is to be built into an electronic device, can be downsized in an appropriate relationship with the grounding area 10 using a very small-sized helical antenna 1. Thus, without hindering the downsizing of the electronic device, the increased gain of the antenna module 6 can be realized.

(Embodiment 2)

In the second embodiment, an explanation will be given of realization of both downsizing and high performance of the antenna module 6 when it is arranged in a mounting dent formed in a box for an electronic device. The explanation will be also given of the electronic device in which the antenna module has been built.

Figure 12:
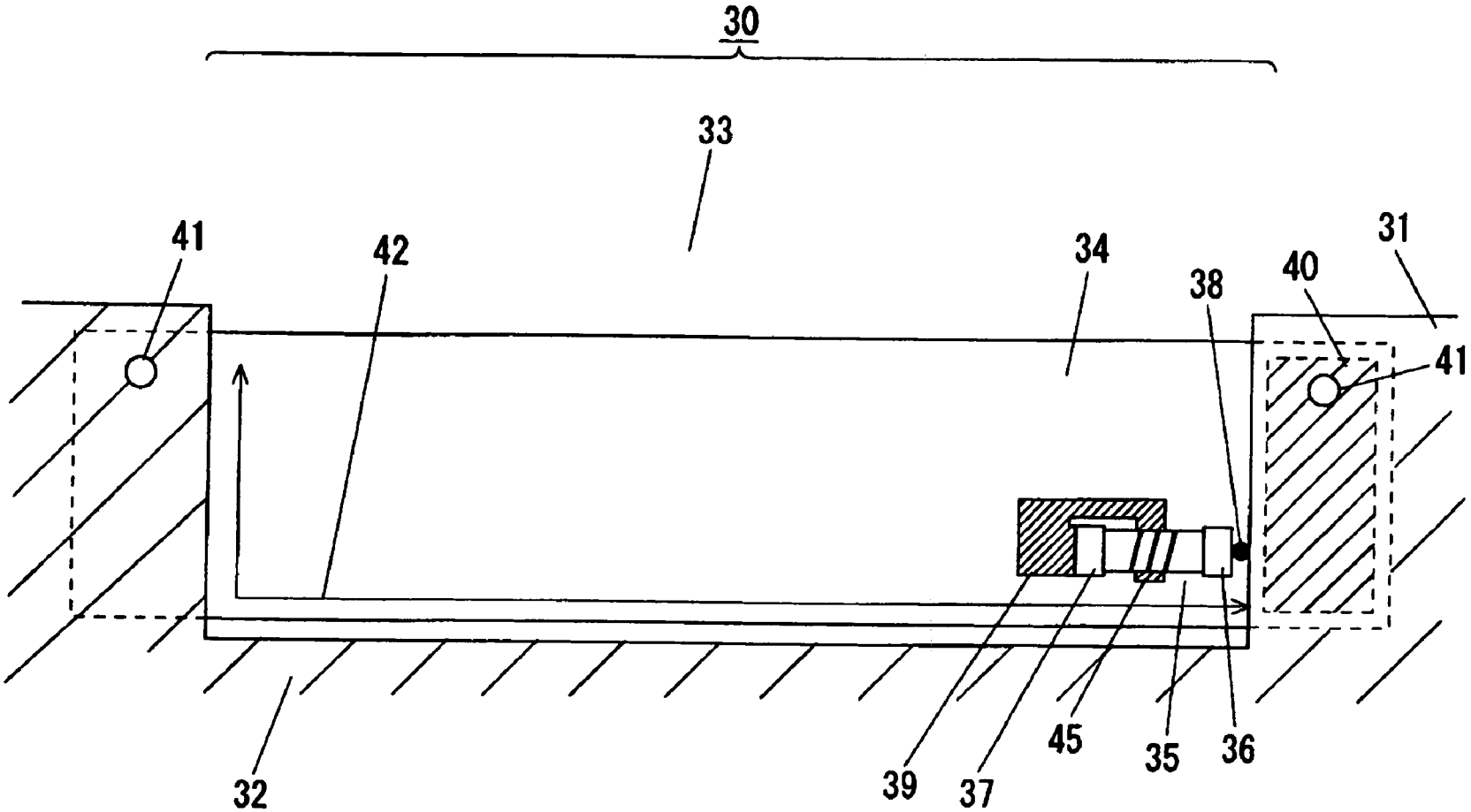
FIG. 12 is an arrangement view of an antenna module according to a second embodiment of this invention.
Figure 13:
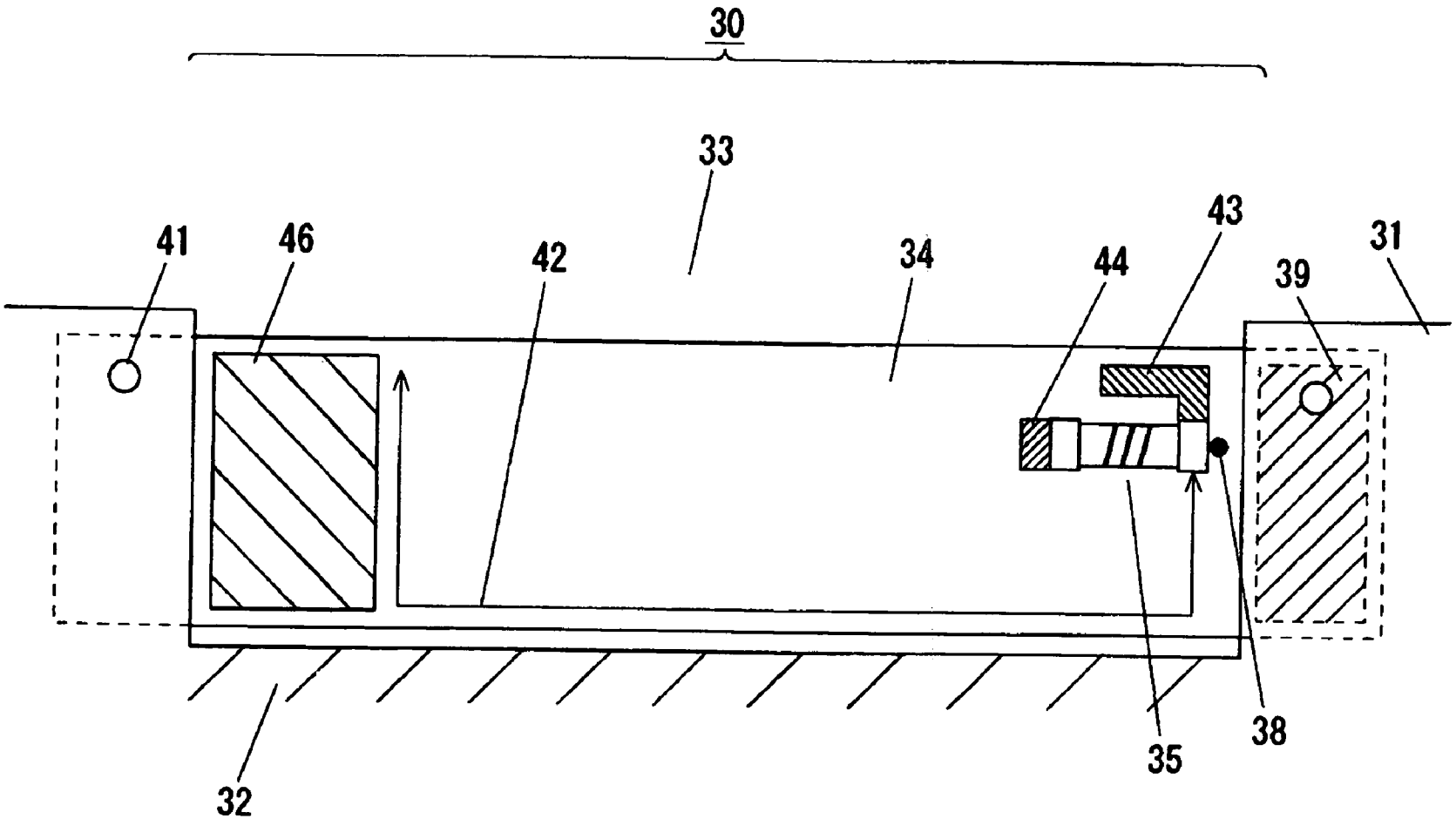
FIG. 13 is an arrangement view of an antenna module according to a second embodiment of this invention.
Figure 14:
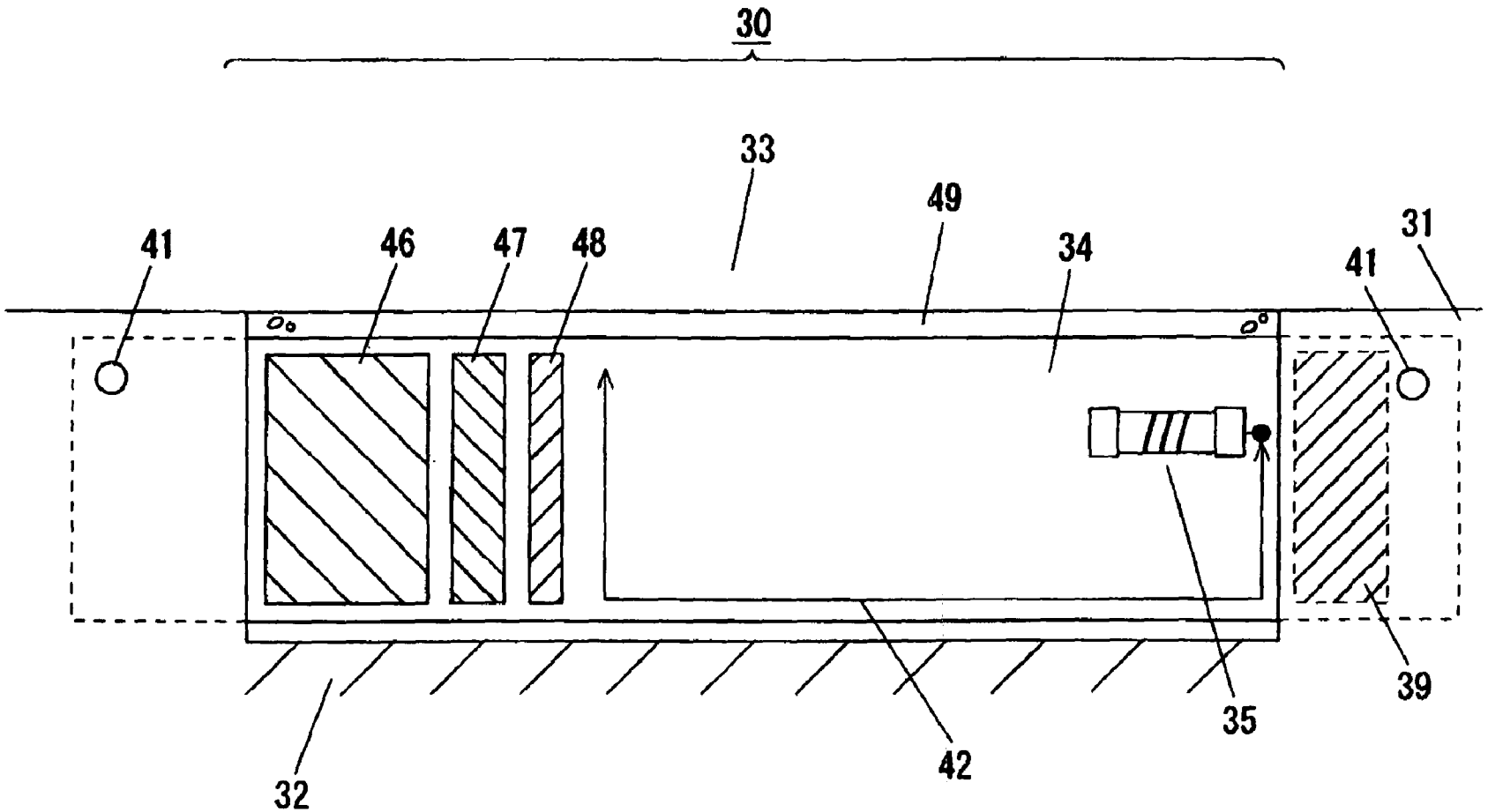
FIG. 14 is an arrangement view of an antenna module according to a second embodiment of this invention.
Figure 15:
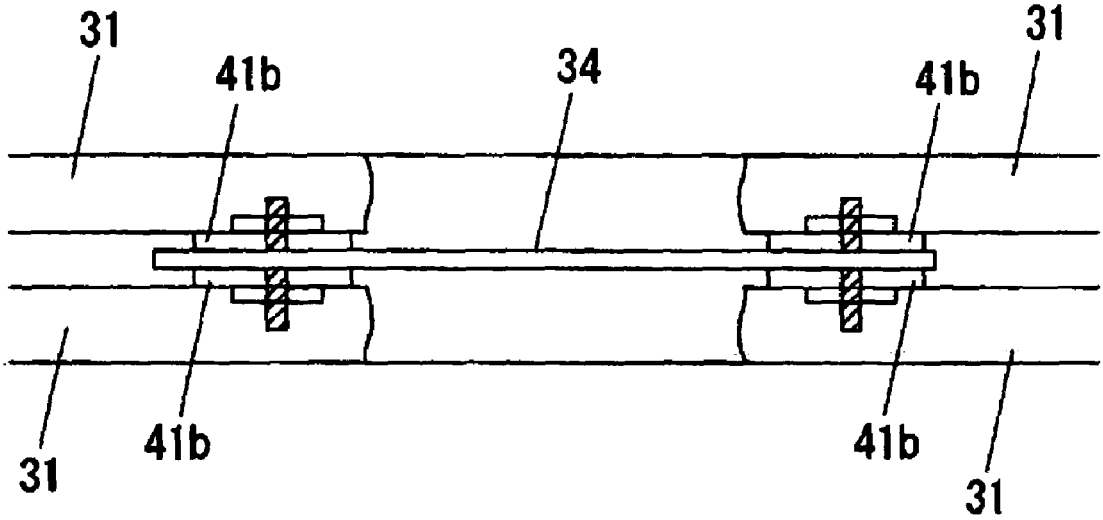
FIG. 15 is a top view of an antenna module according to a second embodiment of this invention.
Figure 16:
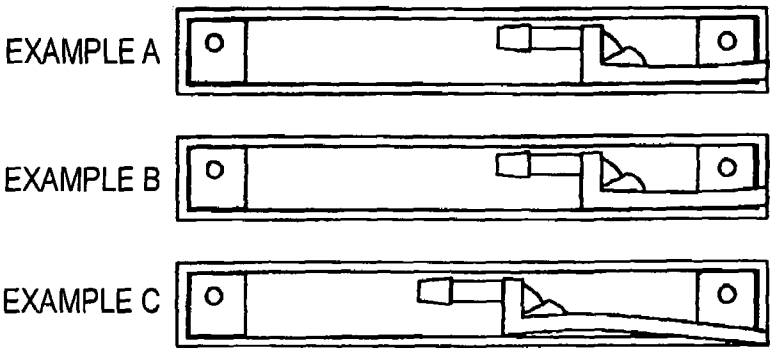
FIG. 16 is views showing the experimental results of an antenna module according to a second embodiment of this invention.
Figure 16:
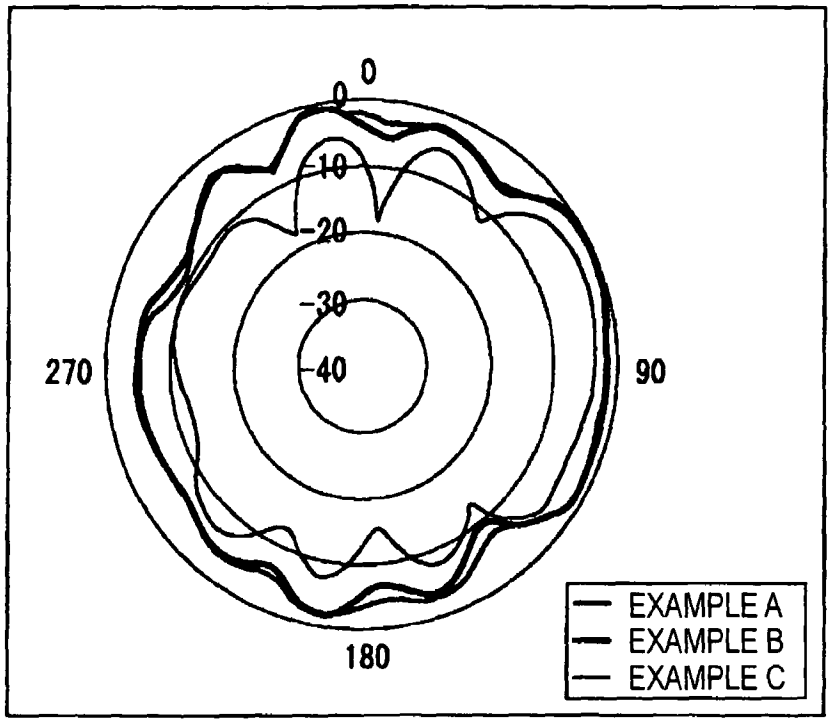
Figure 17:
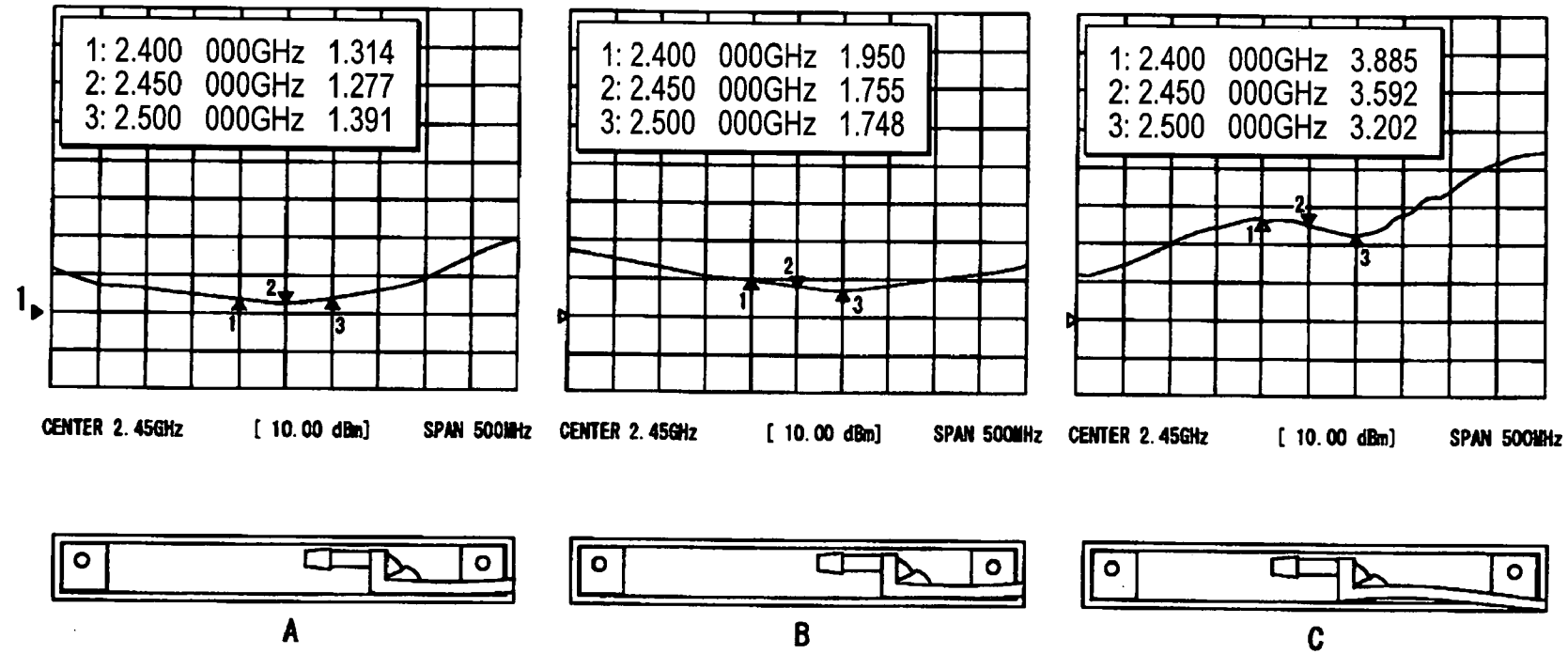
FIG. 17 is views showing the experimental results of an antenna module according to a second embodiment of this invention.
Figure 18:
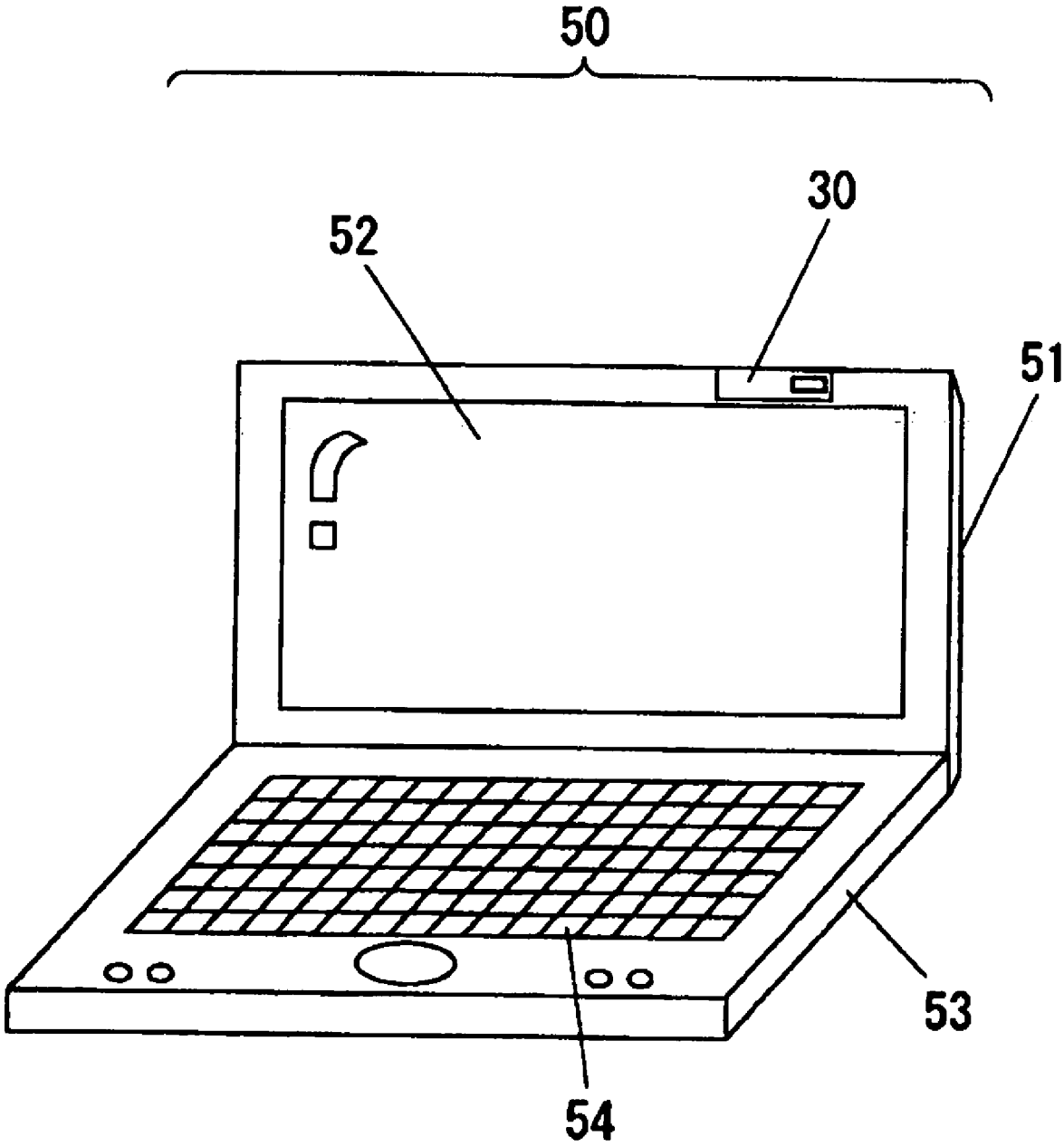
FIG. 18 is a perspective view of a notebook personal computer according to the second embodiment of this invention.
Figure 19:
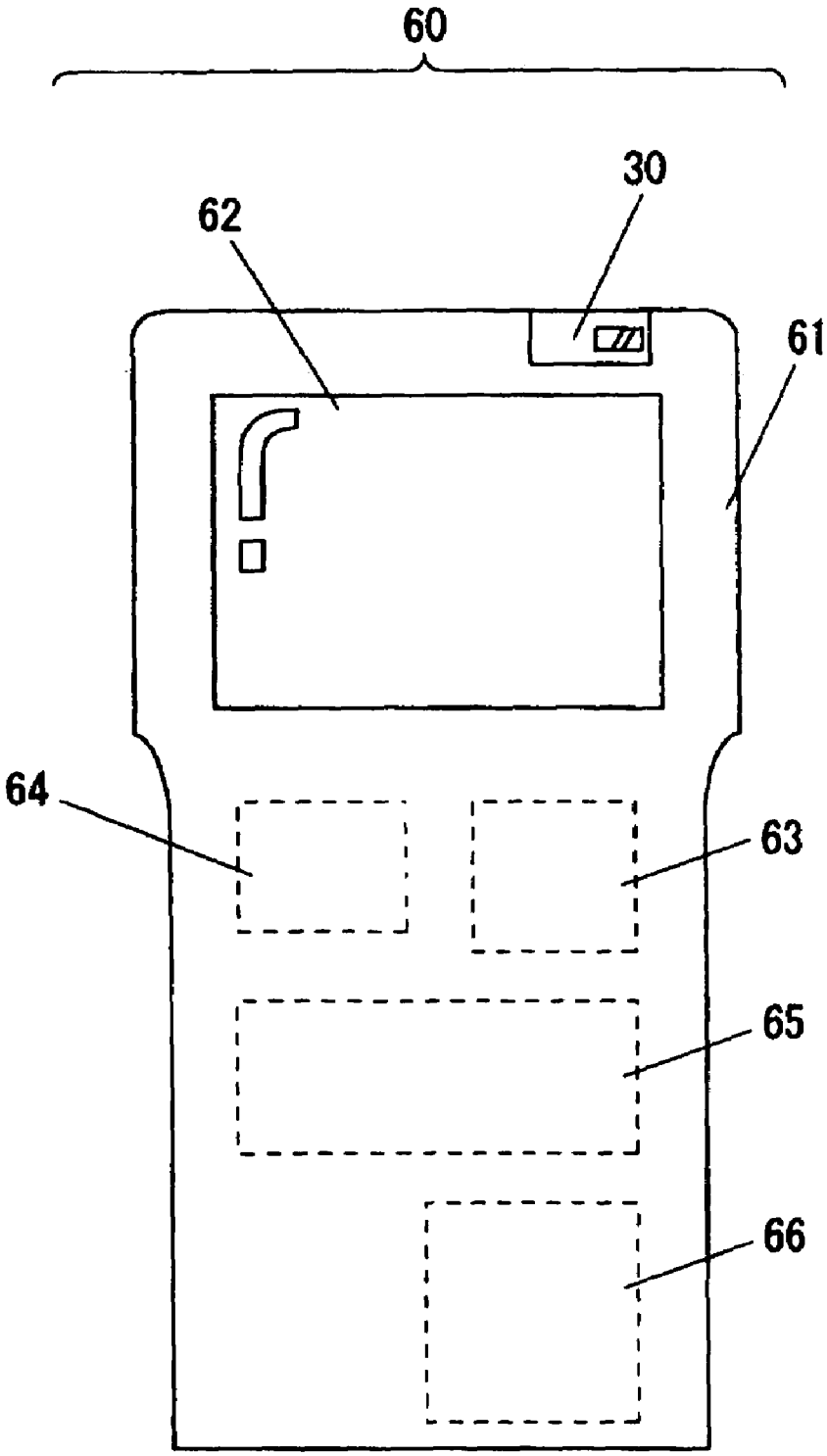
FIG. 19 is an arrangement view of a portable terminal according to the second embodiment of this invention.

FIGS. 12 to 14 are views showing the arrangement of the antenna module according to the second embodiment of this invention. FIG. 15 is a top view of the antenna module according to the second embodiment of this invention. FIGS. 16 and 17 are graphs showing experimental results in the antenna module according to the second embodiment of this invention. FIG. 18 is a perspective view of a notebook personal computer according to the second embodiment of this invention. FIG. 19 is a view showing the arrangement of a portable terminal according to the second embodiment of this invention.

In these figures, reference numeral 30 denotes an antenna module; 31 a portion of a box; 32 a conductor, 33 a mounting dent; 34 an antenna substrate; 35 a helical antenna; 36, 37 a terminal; 38 a power supply; 39 an opening; 40 a grounding area; 41*b* a dielectric member; 41 a connecting segment; 42 a peripheral length of the conductive portion; 43 a pattern antenna; 44 a top-cup conductor, 45 a bottom conductor; 46 an additive conductor; 47, 48 an additive conductor for adjustment; 49 a protective member; 50 a notebook personal computer; 51 a first box; 52 a display portion; 53 a second box; 54 an input device; 60 a portable terminal; 61 a box; 62 a display portion; 63 a transmission processing unit; 64 a reception processing unit; 65 a control unit; and 66 a power source.

Referring to FIGS. 12 to 15, an explanation will be given of the antenna module.

First, the details of each of the components of the antenna module will be explained. In this embodiment, like reference numerals refer to like components in the first embodiment.

A part 31 of the box will be first explained.

The part 31 of the box is a part of the box constituting an electronic device such as a notebook personal computer as shown in FIGS. 16 and others, and may be a part of its outer edge. At one of a central portion, on the rear surface, front surface or side surface thereof, the mounting dent 33 described below is formed.

The part 31 of the box is mostly provided with the conductor 32 formed on the surface or inside thereof. For example, in the case of the notebook personal computer, its surface is mostly coated with an Mg alloy. It is of course that as the case may be, the surface is coated with the other metal such as Cu, Ag, Au, alloy, and the structure within the box is formed of the conductor such as metal.

The mounting dent 33 will be explained.

The mounting dent 33 is provided by forming a notch or recess in the part 31 of the box. For example, if the recess is formed to cut away the outer edge of the box, the mounting dent 33 in a ⊃-shape is formed. If the recess is formed at the central portion of the conductor, the mounting dent 33 in a □-shape is formed. Within the mounting dent 33 thus formed, the helical antenna 35 can be mounted so that the antenna can be easily incorporated within the box, i.e., the electronic device. Further, since a redundant thing such as a projection is not formed on an outer appearance, the outer appearance is not impaired, an pleasant feeling is not given to a user and the cause for failure can be excluded previously.

In FIGS. 12 and others, the longitudinal direction of the the mounting dent 33 constitutes a long side whereas the direction perpendicular thereto constitutes a short side. However, according to the shape of the mounting dent 33, the reverse thereof may be adopted. The mounting dent 33 may be formed in a square shape, may be chamfered at the comers, or may be formed in various shapes inclusive of an ellipse, circle and semicircle taking design into consideration.

The antenna substrate 34 is housed/mounted in the mounting dent 33. As described in connection with the first embodiment, the antenna substrate 34 may be made of epoxy, or the other resin. Further, the helical antenna 35 is mounted on the antenna substrate 34. As described in connection with the first embodiment, the helical antenna 35 is provided with a pair of terminals 36 and 37 and a helical segment on the base, thereby realizing the antenna module 30 operating at the resonance frequency depending on the helical antenna 35.

Further, in the mounting dent 33, the peripheral length of the conductive portion which is the length of the conductor 32 in the longitudinal direction of the helical antenna 35 from an origin of the power supply 38 is preferably adjusted to approximately integer times as long as 0.2λ to 0.3λ (preferably ¼λ) of the transmission/reception frequency. As described later, this is because the mounting dent 33 as well as the helical antenna operates as an antenna for radiating radio waves, thereby improving the gain of transmission/reception. Considering this fact, the size of the mounting dent 33 is preferably adjusted.

Next, the helical antenna 35 will be explained.

The terminal 36 of the helical antenna 35 is connected to the power supply 38. The power supply 38 is preferably located at the one end of the mounting dent 33. Thus, the current (or voltage) from the origin of the power supply 38 is appropriately distributed over the conductor 32 of the part 31 of the box covering the lower surface of the mounting dent 33. The secondary radiation of radio waves occurs from the mounting dent 33 as described later, thereby improving the gain.

As shown in FIG. 12, the helical antenna 35 may be provided with a top-cup conductor formed at the opening 39. The helical antenna 35 may be provided with the bottom conductor 45, thereby realizing the wide bandwidth in transmission/reception.

Otherwise, as shown in FIG. 13, with the power supply 38 being commonly used, the pattern antenna 43 may be formed on the antenna substrate 34. As described in connection with the first embodiment, if the wavelength of transmission/reception is at a very high frequency and hence very short, using such a simple pattern antenna 43, multi-resonance can be easily realized.

Next, the power supply 38 will be explained.

The power supply 38 is preferably located at the one end of the mounting dent 33. This is because such a location facilitates impedance matching between the grounding area and power supply, thus improving the gain.

Further, as described later, in order that the peripheral length of the conductive portion of the mounting dent 33 is assured without increasing the size of the box, the power supply 38 which is the origin of the peripheral length of the conductive portion is preferably located at the one end of the mounting dent 33.

Next, the grounding area 40 will be explained.

The grounding area 40 may be formed on the antenna substrate 34 or within the box. Otherwise, the grounding area 40 may be formed on another electronic substrate existing within the box so that it is located at the position opposite to the opening 39 in the vicinity of the power supply 38 of the helical antenna 35. Incidentally, the size of the grounding area 40 influences on an image current to be generated so that the grounding area 40 preferably has a possible sufficient size. Further, where the end surface of the grounding area 40 is nearly perpendicular to the longitudinal direction of the helical antenna 35, the image current has a vector equivalent to the current flowing through the helical antenna 35 to maximize the current distribution, thereby improving the gain of transmission/reception.

Further, the grounding area 40 may be located in the mounting dent 33 or within the box. However, the grounding area 40 is preferably located within the box in view of easiness of designing and manufacturing.

Next, the connecting segment 41 will be explained.

The connecting segment 41 connects the antenna substrate 34 and the part 31 of the box. The connection is made by various techniques such as bolting or screwing, or fitting by bonding or mortising.

In this case, as shown in FIG. 15, if the part 31 of the box is connected to the antenna substrate 34 through the insulating dielectric member **41*b*, the capacitor component is generated, thereby giving a merit of facilitating the impedance matching of the antenna. Particularly, although the capacitor component is required for the impedance matching, in order to realize this, some redundant electronic components must be mounted on the antenna substrate 34**. This presents many demerits in labor, cost, down-sizing and appearance. In this embodiment, since the connecting segment is formed through the insulating dielectric member, the above demerit can be cancelled, and the merit of assuring the impedance matching can be provided.

Referring to FIG. 13, the additive conductor 46 will be explained.

The additive conductor 46 is provided in order to adjust the peripheral length 42 of the conductive portion.

Specifically, in the mounting dent 33, if the peripheral length 42 from the power supply 38 is adjusted to nearly integer times as long as 0.2λ to 0.3λ (preferably ¼λ) of the transmission/reception frequency, the mounting dent 33 operates as the antenna to expand the radiation (reception), thereby improving the gain of transmission/reception. Thus, without exerting a bad influence on the appearance of the electronic device, the antenna can be incorporated. In addition, without hindering down-sizing of the antenna module, the improvement of the gain of transmission/reception, which is a very important performance in the antenna performance, can be simultaneously realized. It is of course that the wide bandwidth can be realized by the use of the top-cup conductor 44 and bottom conductor 45.

However, according to the conditions of the electronic device, appearance design or balance with the intensity, as the case may be, the dimension of the mounting dent 33 cannot be adjusted to integer times as long as 0.2λ to 0.3λ (preferably ¼λ) of the transmission/reception frequency.

In order to obviate such an inconvenience, the additive conductor 46 is arranged. Thus, the peripheral length 42 of the conductive portion can be adjusted to integer times as long as ¼λ of an optimum transmission/reception frequency, thereby surely improving the gain of transmission/reception. In this case, the area of the additive conductor 46 can be adjusted afterward through laser trimming, stripping by the other physical means, or shortening by hot melting. Thus, where the peripheral length 42 of the conducting portion from the power supply 38 is longer than nearly integer times as long as ¼λ of the transmission/reception frequency according to the shape of the mounting dent 33, because of the presence of this additive conductor 46, the conductor length in the longitudinal direction of the helical antenna 35 is shortened. Correspondingly, the whole peripheral length 42 of the conducting portion is shortened so that it can be adjusted to integer times as long as ¼λ of the transmission/reception frequency, thereby improving the gain of transmission/reception.

Otherwise, the additive conductor 46 may be provided previously. And in actually mounting the antenna module 30, where fine adjustment is required or the helical antenna 35 is changed to vary the objective transmission/reception frequency, the area of the additive conductor 46 is adjusted by trimming or melting so that the peripheral length can be likewise adjusted to nearly integer times as long as the ¼λ of the transmission/reception frequency, thereby improving the gain of transmission/reception.

Otherwise, as explained in connection with the first embodiment, the additive conductors 47 and 48 for adjustment may be provided as shown in FIG. 4. In this case, by stripping or trimming a part of these additive conductors 47 and 48, the adjustment can be facilitated. Namely, the peripheral length 42 of the conductive portion can be easily adjusted to integer times as long as 0.2λ to 0.3λ (preferably ¼λ) of the transmission/reception frequency, thereby improving the gain of transmission/reception.

Incidentally, the additive conductor 46 may be formed on the antenna substrate 34, may be provided within the box or may be formed on another mounting substrate within the box.

Next, the protective member 49 will be explained.

The protective member 49 serves to align the height of the mounting dent 33 of the recess made in the part 31 of the box to the surface of the surrounding box, and protect the internal helical antenna 35 without exposing it.

In this case, the protective member 49 is preferably made of resin so that radiation of radio waves is not hindered. If the protective member 49 is made of transparent resin, the inside can be seen to give good design. Further, since the inside condition can be confirmed, failure such as poor connection can be easily confirmed. Further, if the protective member 49 is made detachable, and the box and antenna substrate 34 connected through the connecting segment 41 are made detachable, component replacement in failure is facilitated, changes in the transmission/reception frequency can be made, and the gain can be adjusted afterwards.

As understood from the description hitherto made, the antenna module optimally built into a box can be realized which incorporates the antenna without impairing the outer appearance of various electronic devices and externally protruding a redundant thing such as a projection and also can improve the gain of transmission/reception of the incorporated antenna without hindering the downsizing and sliming of the electronic devices.

The causes of the improvement of the transmission/reception gain can be explained similarly to the first embodiment.

The first cause is that since there is the grounding area 40 whose end face is nearly perpendicular to the longitudinal direction of the helical antenna 35, the image current is generated in the same vector direction as the current flowing through the helical antenna 35, thereby improving the gain.

The second cause is that since the power supply 38 is located at the one end of the mounting dent 33, the power supply 38 is near the grounding area 40, thereby enhancing the effect of the grounding face of the grounding area 40 and also facilitating the impedance matching.

The third cause is that since the peripheral length 42 of the conductive portion from the power supply 38 surrounding the periphery of the helical antenna 35 is set at integer times as long as the ¼ wavelength of the transmission/reception frequency, the conductive portion serves as a kind of secondary radiation member, thereby increasing the transmission/reception gain.

Specifically, not only the helical antenna 35 but also the conductive portion such as the peripheral conductor formed on the periphery thereof serves as an antenna. And if its peripheral length is nearly integer times as long as 0.2λ to 0.3λ (preferably, ¼λ) of the transmission/reception frequency, the distribution of the electric field is optimum, thereby increasing the gain of transmission (or reception) at this frequency.

Sine these causes are combined with one another, the antenna module 30, even if it is built into the box of an electronic device, can provide a greatly increased gain of transmission/reception.

Next, an explanation will be given of the experimental results of gain improvement of the antenna module described above.

FIG. 16 shows numerical values of directivity and gain of the antenna modules according to this invention and a comparative example. FIG. 17 shows the results of VSWR according to this invention and a comparative example.

Example A is an antenna module satisfying the constituents of this invention; example B is an antenna module in which the peripheral length 42 of the conductive portion is longer than ¼λ and not integer times as long as this wavelength; and example C is an antenna module in which the power supply 38 is not located at the end of the mounting dent 33 to show a poor relationship with the grounding area 40.

As apparent from FIG. 17, although the pattern of directivity is similar in any antenna module, example A which is the antenna module according to this invention is the most excellent in its extent and non-directivity. This is true in the gain of transmission/reception.

Further, as apparent from FIG. 17, as regards the VSWR (voltage standing wave ratio) characteristic also, example A which is the antenna module according to this invention is the most excellent.

As described above, the effect of this invention is also dear from the above actual experimental results.

Finally, referring to FIGS. 18 and 19, an explanation will be given of the case where the antenna module 30 is applied to an actual electronic device.

FIG. 18 illustrates a notebook personal computer serving as an electronic device. FIG. 19 illustrates a portable terminal serving as the electronic device.

Incidentally, the electronic device in which the antenna module 30 is to be built should not be limited to these notebook personal computer and portable terminal, but may be any one of an in-home telephone for wireless communication, child machine of a cordless telephone, card reader, wireless LAN terminal, terminal, gateway, PBX, etc.

First, referring to FIG. 18, the notebook personal computer will be explained. The exterior of a notebook personal computer 50 consists of mainly a first box 51 having a display portion 52 formed of liquid crystal and a second box 53 which is rotatably connected to the first box. In recent years, in order to keep the balance between the strength and weight reduction, as the case may be, the surface of these boxes are made of a Mg alloy. In this case, even f the antenna is incorporated, the metallic face of the Mg alloy which serves as a shield makes it impossible to perform external communication.

In many cases, the second box 53 is provided with an input device 54 such as a key board or a touch panel. Although not shown, the second box 53 incorporates a central processing unit (CPU), a storage device such as a hard disk drive, a power source, various control devices, wireless processing device, external storage device, etc.; necessary integrated circuits and electronic components are mounted on an electronic substrate.

This notebook personal computer 50 is provided with a mounting dent formed by making a recess on the outer edge which is an upper side of the first box 51 in FIG. 18.

The antenna module 30 is mounted in this mounting dent. The outer surface thereof is covered with the protective member 49.

In such a configuration, without influencing on the outer appearance and upsizing the devices, as described above, the wireless communication with a high gain of transmission/reception can be realized.

For example, the above configuration is suited to the case of implementing wireless LAN.

Incidentally, the antenna module 30 may be arranged at not the upper external edge but the side edge thereof, or may be arranged at any position of the second box 53. The antenna module 30 may be arranged so that it conceals when the first box 51 is dosed.

Inversely, the antenna module may be arranged at the sides opposite to the mating plane of the first box 51 and second box 53. These arrangements may be appropriately determined considering the conditions of the devices and convenience of mounting.

Next, referring to FIG. 19, an explanation will be given of the case where the antenna module 30 is mounted in the portable terminal.

Actually, entry keys and others are provided on the surface of a box 61. But the illustration is made assuming that an internal transmission processing unit 63 and others can be seen in perspective representation.

A power source 66 is realized by a packed battery. The power source 66 supplies electric power to the terminal. A control unit 65 includes a CPU and others. By these peripheral circuits and programs, synchronizing processing and command processing are performed.

The transmission signal processed by a transmission processing unit 63 is radiated through the antenna module 30. Inversely, the signal received by the antenna module 30 is demodulated by a reception processing unit 64 and reproduced as audio data and others. As the occasion demands, the contents of processing are displayed on a display portion 62.

In this case also, without externally protruding a redundant projection from the box and impairing the outer appearance, the devices are downsized and the wireless communication with a high gain of transmission/reception can be realized while downsizing the device.

Incidentally, in this case also, the antenna module 30 is provided at the upper edge of the box. However, the antenna module 30 may be provided on the side edge or at a central position.

As described above, by building the antenna module 1, 30 according to the first or the second embodiment into an electronic device, without impairing the outer appearance of the electronic device, hindering the operability of a user, and keeping the downsizing/slimming of the device, the gain of transmission/reception can be improved.

In addition, the antenna modules according to the first and the second embodiment also contribute reduction of their production cost.

Figure 20:
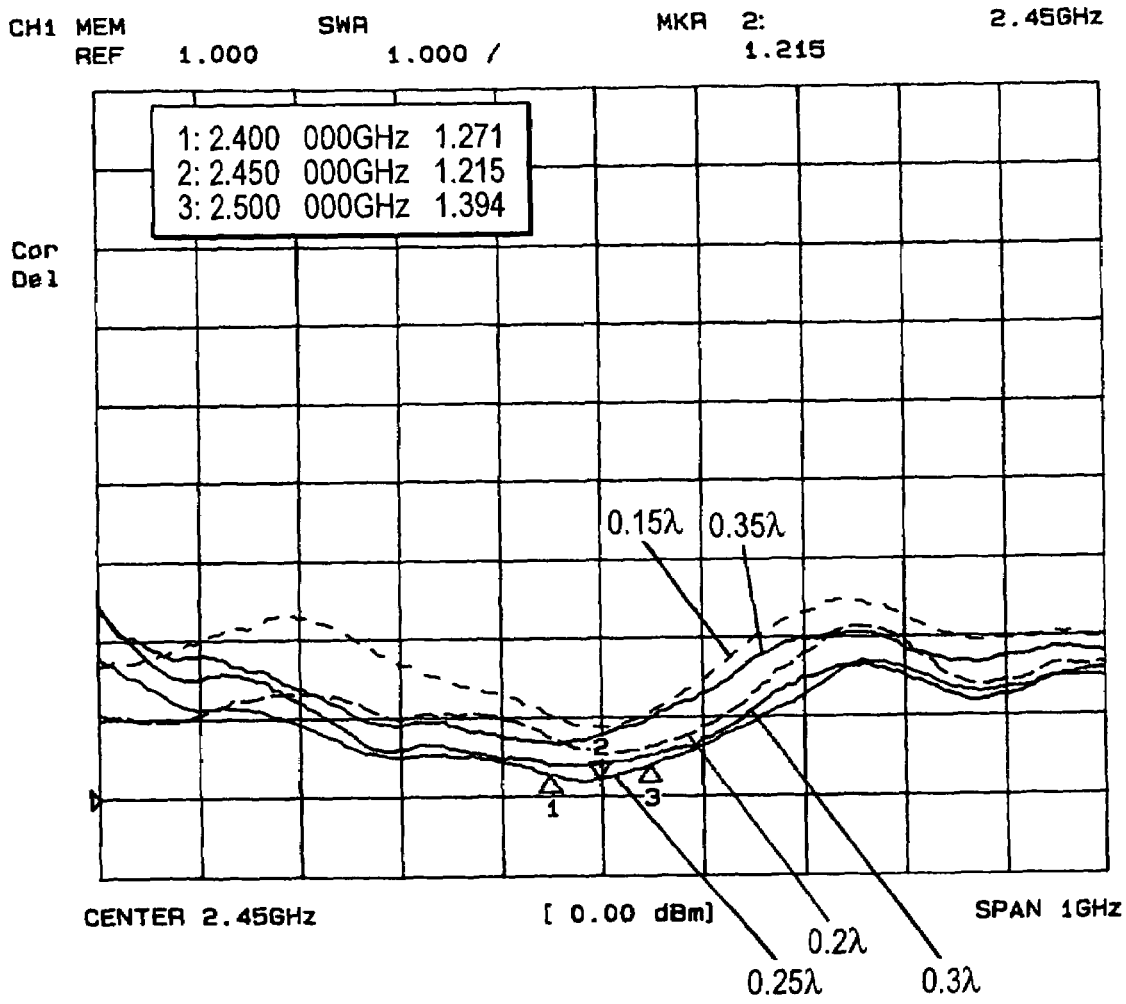
FIG. 20 is a graph showing the efficiency of the antenna module according to this invention.
Figure 21:
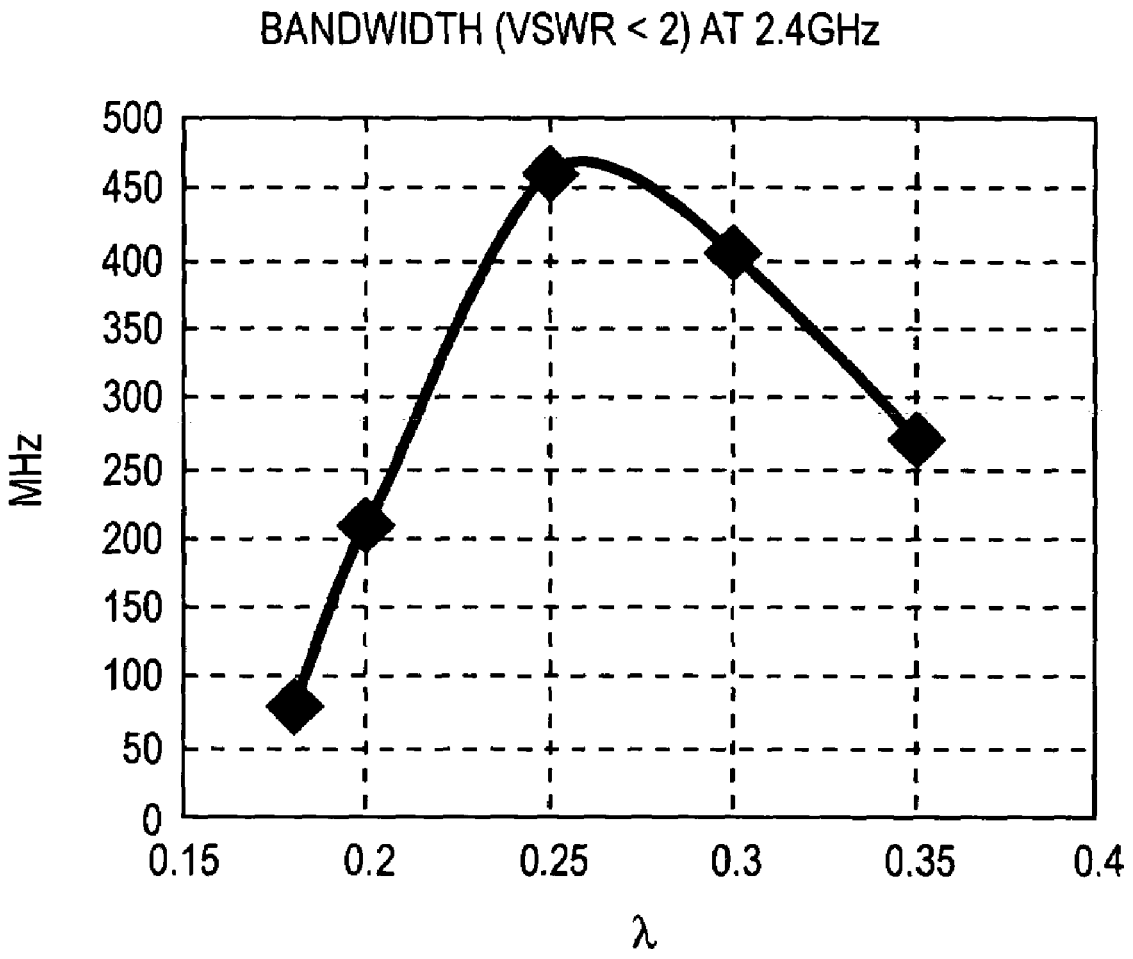
FIG. 21 is a graph showing the efficiency of the antenna module according to this invention.

FIGS. 20 and 21 are graphs showing that it is efficient that the peripheral length of a peripheral conductive portion formed on the periphery of the antenna substrate is nearly integer times as long as 0.2λ to 0.3λ of a resonance frequency. FIG. 21 shows the bandwidth in which VSWR is 2 or less. In the bandwidth at 2.4 GHz, the frequency of 100 MHz or higher is demanded so that 0.18λ is not preferable in characteristic.

At 0.35λ, the bandwidth is satisfactory as shown in FIG. 21. However, as seen from FIG. 20, the frequency shifts a lower side so that 0.35λ is not preferable in characteristic. Thus, it provides the range sufficiently satisfying the characteristic that the peripheral length of the conductive portion formed on the periphery of the antenna substrate is nearly integer times as long as 0.2λ to 0.3λ of the resonance frequency.

This invention provides an antenna module comprising: a helical antenna including a base and a pair of terminals and a helical area formed on the base; a power supply for supplying power to one of the pair of terminals of the helical antenna; an opening connected to the other of the pair of terminals; an antenna substrate on which the antenna is mounted; a grounding area formed in the vicinity of the power supply; and a peripheral conductor formed at least a portion of the periphery of the antenna substrate, wherein the peripheral length of the peripheral conductor formed on the periphery of the antenna substrate is nearly integer times as long as ¼ wavelength of a resonance frequency.

The antennal module according to this invention can be applied to uses which requires the merit of capable of improving the gain and assuring high directivity.

This application is based upon and claims the benefit of priority of Japanese Patent Application No2004-044274 filed on Feb. 20, 2004, the content of which is incorporated herein by references in its entirety.

What is claimed is:

1. An antenna module comprising:

an antenna having a base, and a pair of terminals and a conductor formed on the base;

a power supply, supplying power to one of the pair of terminals;

an opening, connected to the other of the pair of terminals;

an antenna substrate, on which the antenna is mounted;

a grounding area, formed in the vicinity of the power supply; and a peripheral conductor, formed at least a portion on the periphery of the antenna substrate, wherein the peripheral length of the peripheral conductor formed on the periphery of the antenna substrate is nearly integer times as long as 0.2 wavelength to 0.3 wavelength of a resonance frequency.

2. The antenna module according to claim 1, wherein the peripheral length of the peripheral conductor formed on the periphery of the antenna is nearly integer times as long as 0.2 wavelength to 0.3 wavelength of the resonance frequency from an origin of the power supply.

3. The antenna module according to claim 1, wherein an additive conductor is provided at a partial area on the antenna substrate other than the periphery thereof.

4. The antenna module according to claim 1, wherein the additive conductor is electrically connected to the peripheral conductor.

5. The antenna module according to claim 1, wherein the peripheral length of a conductive portion composed of the additive conductor and the peripheral conductor and formed on the periphery of the antenna is nearly integer times as long as 0.2 wavelength to 0.3 wavelength of the resonance frequency.

6. The antenna module according to claim 1, wherein the length or area of at least one of the additive conductor and the peripheral conductor is changeable.

7. The antenna module according to claim 6, wherein the area is changed by trimming.

8. The antenna module according to claim 1, wherein the additive conductor is formed on the side opposite to the grounding area.

9. The antenna module according to claim 1, wherein a pattern antenna is connected to the power supply, commonly to the antenna.

10. The antenna module according to claim 1, wherein a top-cup conductor is formed at the opening of the antenna.

11. The antenna module according to claim 1, wherein a bottom conductor connected to the opening is formed at an area opposite to the conductor of the antenna on the antenna substrate.

12. An antenna module comprising:

a mounting dent, formed at any portion of a box and having a periphery covered with a conductor;

an antenna substrate, fit in the mounting dent;

an antenna, having a pair of terminals and a conductor formed on a base, the antenna being mounted on the antenna substrate;

a power supply, supplying power to one of the pair of terminals, the power supply being provided on the antenna substrate;

an opening, formed on the antenna substrate and connected to the other of the pair of terminals, wherein the peripheral length of the conductor surrounding the mounting dent is integer times as long as 0.2 wavelength to 0.3 wavelength of a resonance frequency, and the power supply is formed at the one end of the mounting dent.

13. The antenna module according to claim 12, wherein the peripheral length of the conductor surrounding the mounting dent is integer times as long as 0.2 wavelength to 0.3 wavelength of the resonance frequency from an origin of the power supply.

14. The antenna module according to claim 12, wherein the conductor is formed at least a portion of the side which is not opposite to a grounding area and in nearly parallel to the longitudinal direction of the antenna.

15. The antenna module according to claim 12, wherein a grounding area is formed in the vicinity of the power supply and at a position opposite to the opening.

16. The antenna module according to claim 12, wherein an additive conductor is formed at an end of the mounting dent opposite to the power supply.

17. The antenna module according to claim 12, wherein the length or area of the additive conductor is changeable.

18. The antenna module according to claim 12, wherein the length or area of the additive conductor is changeable so that the peripheral length of the conductor from an origin of the power supply on the antenna substrate can be adjusted.

19. The antenna module according to claim 12, wherein a pattern antenna is connected to the power supply, commonly to the antenna.

20. The antenna module according to claim 12, wherein on the antenna substrate, a top-cup conductor is formed at the opening of the antenna, and/or a bottom conductor is formed on the surface opposite to the conductor connected to the opening.

21. The antenna module according to claim 12, wherein the mounting dent is a recess formed in any position of the end surface of the box.

22. The antenna module according to claim 12, wherein the periphery of the mounting dent is covered with a protective member.

23. The antenna module according to claim 22, wherein the protective member has transparency.

24. The antenna module according to claim 12, wherein the mounting dent is ⊃-shaped.

25. The antenna module according to claim 12, wherein the longitudinal direction of the antenna is in nearly parallel to that of the mounting dent.

26. The antenna module according to claim 12, wherein at least one of the grounding area and the additive conductor is formed on the antenna substrate, at least one of the grounding area and the additive conductor has a connecting segment to the box, and the antenna substrate is connected to the box at the connecting segment through a dielectric member.

27. The antenna module according to claim 13, wherein on the antenna substrate, a top-cup conductor is formed at the opening of the antenna, and/or a bottom conductor is formed on the surface opposite to the conductor connected to the opening.

28. The antenna module according to claim 14, wherein on the antenna substrate, a top-cup conductor is formed at the opening of the antenna, and/or a bottom conductor is formed on the surface opposite to the conductor connected to the opening.

29. The antenna module according to claim 15, wherein on the antenna substrate, a top-cup conductor is formed at the opening of the antenna, and/or a bottom conductor is formed on the surface opposite to the conductor connected to the opening.

30. The antenna module according to claim 16, wherein on the antenna substrate, a top-cup conductor is formed at the opening of the antenna, and/or a bottom conductor is formed on the surface opposite to the conductor connected to the opening.

31. The antenna module according to claim 17, wherein on the antenna substrate, a top-cup conductor is formed at the opening of the antenna, and/or a bottom conductor is formed on the surface opposite to the conductor connected to the opening.

32. The antenna module according to claim 18, wherein on the antenna substrate, a top-cup conductor is formed at the opening of the antenna, and/or a bottom conductor is formed on the surface opposite to the conductor connected to the opening.

33. The antenna module according to claim 19, wherein on the antenna substrate, a top-cup conductor is formed at the opening of the antenna, and/or a bottom conductor is formed on the surface opposite to the conductor connected to the opening.

* * * * *